US009570283B2

(12) United States Patent
Makarov et al.

(10) Patent No.: US 9,570,283 B2
(45) Date of Patent: *Feb. 14, 2017

(54) ELECTROSTATIC TRAP

(71) Applicant: Thermo Fisher Scientific (Bremen) GmbH, Bremen (DE)

(72) Inventors: Alexander A. Makarov, Bremen (DE); Eduard V. Denisov, Bremen (DE); Gerhard Jung, Delmenhorst (DE); Wilko Balschun, Bremen (DE); Stevan R. Horning, Delmenhorst (DE)

(73) Assignee: Thermo Fisher Scientific (Bremen) GmbH, Bremen (DE)

( * ) Notice: Subject to any disclaimer, the term of this patent is extended or adjusted under 35 U.S.C. 154(b) by 0 days.

This patent is subject to a terminal disclaimer.

(21) Appl. No.: 14/832,978

(22) Filed: Aug. 21, 2015

(65) Prior Publication Data

US 2015/0364316 A1 Dec. 17, 2015

Related U.S. Application Data

(63) Continuation of application No. 14/596,187, filed on Jan. 13, 2015, now Pat. No. 9,117,647, which is a (Continued)

(30) Foreign Application Priority Data

Jun. 3, 2005 (GB) ..... 0511375.8

(51) Int. Cl.
*H01J 49/42* (2006.01)
*H01J 49/00* (2006.01)
(Continued)

(52) U.S. Cl.
CPC ..... *H01J 49/4245* (2013.01); *H01J 49/0027* (2013.01); *H01J 49/02* (2013.01);
(Continued)

(58) Field of Classification Search
CPC ..... H01J 49/4245
See application file for complete search history.

(56) References Cited

U.S. PATENT DOCUMENTS 6,872,938 B2 3/2005 Makarov et al.
7,399,962 B2 7/2008 Makarov
(Continued)

FOREIGN PATENT DOCUMENTS

EP 1298700 A2 4/2003
GB 2402260 A 12/2004
WO WO 02/078046 A2 10/2002

OTHER PUBLICATIONS

Hardman, et al., "Interfacing the Orbitrap Mass Analyzer to an Electrospray Ion Source," Anal. Chem. , vol. 75 (No. 7), 2003, pp. 1699-1705.

*Primary Examiner* — Wyatt Stoffa
*Assistant Examiner* — Eliza Osenbaugh-Stewart
(74) *Attorney, Agent, or Firm* — A. J. Gokcek

(57) ABSTRACT

An electrostatic trap such as an orbitrap is disclosed, with an electrode structure. An electrostatic trapping field of the form U'(r, ϕ, z) is generated to trap ions within the trap so that they undergo isochronous oscillations. The trapping field U'(r, ϕ, z) is the result of a perturbation W to an ideal field U(r, ϕ, z) which, for example, is hyperlogarithmic in the case of an orbitrap. The perturbation W may be introduced in various ways, such as by distorting the geometry of the trap so that it no longer follows an equipotential of the ideal field U(r, ϕ, z), or by adding a distortion field (either electric or magnetic). The magnitude of the perturbation is such that at least some of the trapped ions have an absolute phase spread of more than zero but less than 2 π radians over an ion detection period $T_m$.

14 Claims, 14 Drawing Sheets

Related U.S. Application Data continuation of application No. 14/269,452, filed on May 5, 2014, now abandoned, which is a continuation of application No. 13/737,771, filed on Jan. 9, 2013, now Pat. No. 8,716,654, which is a continuation of application No. 13/474,020, filed on May 17, 2012, now abandoned, which is a continuation of application No. 12/749,334, filed on Mar. 29, 2010, now Pat. No. 8,198,581, which is a continuation of application No. 10/587,478, filed as application No. PCT/GB2006/002028 on Jun. 5, 2006, now Pat. No. 7,714,283.

(51) Int. Cl.
*H01J 49/28* (2006.01)
*H01J 49/02* (2006.01)
*H01J 49/40* (2006.01)

(52) U.S. Cl.
CPC ..... *H01J 49/282* (2013.01); *H01J 49/406* (2013.01); *H01J 49/425* (2013.01)

(56) References Cited

U.S. PATENT DOCUMENTS

| | | | | |
|---|---|---|---|---|
| 7,714,283 | B2 | 5/2010 | Makarov et al. | |
| 8,198,581 | B2 | 6/2012 | Makarov et al. | |
| 8,716,654 | B2 | 5/2014 | Makarov et al. | |
| 2004/0108450 | A1 | 6/2004 | Makarov et al. | |
| 2006/0214100 | A1* | 9/2006 | Verentchikov et al. | H01J 49/406 250/287 |
| 2014/0239197 | A1 | 8/2014 | Makarov et al. | |

* cited by examiner

ELECTROSTATIC TRAP

CROSS-REFERENCE TO RELATED APPLICATIONS

The present application is a continuation of pending U.S. patent application Ser. No. 14/596,187 filed Jan. 13, 2015, which is a continuation of U.S. patent application Ser. No. 14/269,452 filed May 5, 2014, which is a continuation of U.S. patent application Ser. No. 13/737,771 filed Jan. 9, 2013, now U.S. Pat. No. 8,716,654, which is a continuation of U.S. patent application Ser. No. 13/474,020 filed May 17, 2012, which is a continuation of U.S. patent application Ser. No. 12/749,334 filed Mar. 29, 2010, now U.S. Pat. No. 8,198,581, which is a continuation of U.S. patent application Ser. No. 10/587,478, filed on Sep. 4, 2008, now U.S. Pat. No. 7,714,283, which is a national stage entry of PCT application no. PCT/GB2006/002028, filed Jun. 5, 2006, entitled "Electrostatic Trap", which applications are incorporated herein by reference in their entireties.

FIELD OF THE INVENTION

This invention relates to improvements in an electrostatic trap (EST), that is, a mass analyser of the type where ions injected into it undergo multiple reflections within a field that is substantially electrostatic during ion detection, i.e., any time dependent fields are relatively small. It relates in particular but not exclusively to improvements in the Orbitrap mass analyser first described in U.S. Pat. No. 5,886,346.

BACKGROUND OF THE INVENTION

Electrostatic traps (ESTs) are a class of ion optical devices where moving ions experience multiple reflections in substantially electrostatic fields. Unlike in RF fields, trapping in electrostatic traps is possible only for moving ions. To ensure this movement takes place and also to maintain conservation of energy, a high vacuum is required so that the loss of ion energy over a data acquisition time Tm is negligible.

There are three main classes of EST: linear, where ions change their direction of motion along one of the coordinates of the trap; circular, where ions experience multiple deflections without turning points; and orbital, where both types of motion are present. The so-called Orbitrap mass analyser is a specific type of EST that falls into the latter category of ESTs identified above. The Orbitrap is described in detail in U.S. Pat. No. 5,886,346. Briefly, ions from an ion source are injected into a measurement cavity defined between inner and outer shaped electrodes. The outer electrode is split into two parts by a circumferential gap which allows ion injection into the measurement cavity. As bunches of trapped ions pass a detector (which, in the preferred embodiment is formed by one of the two outer electrode parts), they induce an image current in that detector which is amplified.

The inner and outer shaped electrodes, when energized, produce a hyper-logarithmic field in the cavity to allow trapping of injected ions using an electrostatic field. The potential distribution U(r,z) of the hyper-logarithmic field is of the form $$U(r,z) = \frac{k}{2}\left[z^2 - \frac{r^2}{2}\right] + \frac{k}{2}(R_m)^2 \cdot \ln\left[\frac{r}{R_m}\right] + C \tag{1}$$

where r and z are cylindrical coordinates and z=θ is the plane of symmetry of the field) C is a constant, k is the field curvature and $R_m>0$ is the characteristic radius.

In this field, the motion of ions with mass m and charge q along the axis z is described as a simple harmonic oscillator with an exact solution for q,k>0:

$$z(t) = A_z \cdot \cos(\omega_0 t + \theta) \tag{2}$$

where $$\omega_0 = \sqrt{\frac{qk}{m}} \tag{3}$$

and $T_0$ thus defines the frequency of axial oscillations in radians per second, and $A_z$ and 2 are the amplitude and phase of axial oscillations, respectively.

Whilst the foregoing discusses the theoretical situation, in which the electrodes are of ideal hyper-logarithmic shape, in reality there is a limit to the accuracy with which any practical construction can approximate that ideal geometry. As discussed in "Interfacing the Orbitrap Mass Analyser to an Electrospray Ion Source", by Hardman et al, Analytical Chemistry Vo. 75, No. 7, April 2003, any divergence from the ideal electrode geometry, and/or inclusion of electrical perturbations, will result in a perturbation to the ideal field which in turn will transform the harmonic axial oscillations of the ideal field into non-linear oscillations. This in turn may result in a reduction in mass accuracy, peak shape and height, and so forth.

The present invention, in general terms, seeks to address problems arising from the non-ideal nature of a real electrostatic trap.

SUMMARY OF THE INVENTION

Against this background, aspects of the present invention provide for an electrostatic ion trap in which deliberate non-linearities or perturbations are introduced to the field so as to control or constrain the rate of phase separation of ions within a given bunch (of single m/z). In particular, the present invention provides, in a first aspect, an electrostatic ion trap for a mass spectrometer, comprising an electrode arrangement defining an ion trapping volume, the electrode arrangement being arranged to generate a trapping field defined by a potential U'(r,ϕ,z)=U(r,ϕ,z)+W, where U(r,ϕ,z) is an ideal potential which traps ions in the Z-direction of the trapping volume so that they undergo substantially isochronous oscillations and where W is a perturbation to that ideal potential U(r,ϕ,z), wherein the geometry of the electrode arrangement generally follows one or more lines of equipotential of the ideal potential U(r,ϕ,z) but wherein at least a part of the electrode arrangement deviates to a degree from that ideal potential U(r,ϕ,z) so as to introduce the perturbation W into the said trapping field, the degree of deviation from the ideal potential U(r,ϕ,z) being sufficient to result in the relative phases of the ions in the trap shifting over time such that at least some of the trapped ions have an absolute phase spread of more than zero but less than about 2π radians over an ion detection period $T_m$.

According to a second aspect of the present invention, there is provided an electrostatic ion trap for a mass spectrometer comprising an electrode arrangement defining an ion trapping volume, the electrode arrangement being arranged to generate a trapping field defined by a potential U(r,ϕ,z) where U(r,ϕ,z) is a potential which traps ions in the Z-direction of the trapping volume so that they undergo substantially isochronous oscillations, wherein the trap further comprises field perturbation means to introduce a perturbation W to the potential U(r,ϕ,z) so as to enforce a relative shift in the phases of the ions over time such that at least some of the trapped ions have an absolute phase spread of more than zero but less than about 2π radians over an ion detection period $T_m$.

The specific description provides a detailed theoretical analysis of the non-ideal electrostatic trap and the manner in which perturbations W affect the overall performance of the mass analyser. In general terms, however, it may be noted that there are a very large number of trap parameters which affect the mass analysis to varying degrees, including the degree to which the field generation means approximates the ideal electric field, the accuracy of various dimensions of the trap both in absolute terms and relative to other components of the trap, the accuracy and stability of any voltages applied to generate the field, and so forth. Nevertheless, in broad terms these may be classified into geometric distortions, such as "stretching" of the shape, shifting of the spatial location of the electrodes relative to an equipotential of the ideal field U(r,ϕ,z), oversizing or undersizing the electrodes in one or more dimensions etc, and applied distortions such as voltages applied to the trapping and/or to additional distortion electrodes (eg end cap electrodes), or applied magnetic fields, etc. Of course, whilst it is possible to create the appropriate perturbation W using only one of these (geometric or applied distortion), a suitable perturbation could of course be created using a combination of both a geometric and an applied distortion.

In terms of the effect upon the trapped ions, the non-ideal nature of the trap results in one of two general situations. In the ideal trap, the oscillations in the axial (Z) direction have a frequency $\omega_0$ that is independent of amplitude (apart from a small, asymptotic shift due to space charge effects, regarding which, see later). For a non-ideal trap, and assuming that W, the perturbation, is a function of z (at least), the oscillations in the z direction of ions are no longer independent of amplitude. Instead, the ions either spread out (separate) in phase over time or compress (bunch) together in phase. In the case of phase bunching, this results in various undesirable artefacts such as the so-called "isotope effect" (explained below), poor mass accuracy, split peaks, poor quantitation (i.e. a distortion of the relation between measured and real intensities of peaks) any one of which may be fatal to the analytical performance of the trap. In the case of phase separation, the spread of phases will continue to increase with time. Once the phase spread exceeds π radians, ions start to move with opposite phases, resulting in compensating image currents that progressively reduce the overall signal.

If the phase spreading occurs rapidly (relative to a measurement time $T_m$), then the desirable part of the signal is essentially lost whilst the signal resulting from the phase bunched ions is analytically poor or useless. The present invention in a first aspect provides for a trap with parameters optimized so as to constrain the rate of increase in phase spread. It is likely that a real trap will have parameters that result in a perturbation to the ideal field W which cause some phase spreading. However, if the phase spreading is constrained so as to keep it below about 2π radians, for a time period commensurate with a trap measurement period $T_m$, then non-bunched ions will be detected without degradation in analytical performance.

An alternative way of looking at this is to consider the rate of decay of the 'transient' detected by the detection means. Typically, such a transient is generated by measuring the image current induced in the detection means by ions in the trap. A trap in which there is a rapid decay in the amplitude of the transient, in the time domain, exhibits a poor analytical performance, and in particular the mass accuracy tends to be poor in the Fourier transformed signal.

Thus in accordance with a third aspect of the present invention, there is provided an ion trap for a mass spectrometer, comprising: electric field generation means to produce an electric field within which the ions may be trapped; and detection means to detect ions according to their mass to charge ratio; wherein the electric field generation means is arranged to produce an electric trapping field which traps ions so that they describe oscillatory motion in which the period of oscillations is dependent upon the amplitude of oscillations thereof, so as to cause a shift in the relative phase of ions in the trap over time, wherein the detection means is arranged to generate a time domain transient from the ions in the trap, the transient containing information on those ions, and further wherein the parameters of the trapping field are arranged such that the detected transient decays from a maximum amplitude to no less than a) 1%; b) 5%; c) 10%; d) 30%; e) 50% over an ion detection time $T_m$.

In yet another aspect of the invention there is provided an electrostatic ion trap for a mass spectrometer comprising: electric field generation means to produce an electric field within which the ions may be trapped; and detection means to detect ions according to their mass to charge ratio, wherein the electric field generation means is arranged to produce an electric field of the form, in cylindrical coordinates:

$$U(r,\phi,z)=\frac{k}{2}\left[z^2-\frac{r^2}{2}\right]+\frac{k}{2}(R_m)^2\cdot\ln\left[\frac{r}{R_m}\right]+W(r,\phi,z)$$

where U is the field potential at a location r,ϕ,z; k is the field curvature; $R_m>0$ is the characteristic radius, and W(r,ϕ,z) is a field perturbation, and further wherein W is a function of r and/or ϕ but not z, or wherein W is a function of at least z but wherein, in that case, the field perturbation W causes the period of oscillation of at least some of the ions along the z axis of the trap to increase with the increase in the period of oscillation in that z direction.

Various features of the trap have been ascertained through experiment to result in a perturbation that causes phase bunching to dominate, with the peak from non-bunched ion packets being lost because of a rapid growth in phase shift. Preferred features of the present invention propose controlled distortions to the trap geometry, configuration and/or applied voltages so as to constrain the rate of growth of non-bunched ion packets so that the phase shift does not exceed about 2π radians over the time scale of ion measurement.

In accordance with a further aspect of the present invention there is provided an electrostatic ion trap for a mass spectrometer comprising: electric field generation means to produce an electric field within which the ions may be trapped; and detection means to detect ions according to their mass to charge ratio; wherein the electric field generation means is arranged to produce an electric trapping field which traps ions so that they describe oscillatory motion in which the period of oscillations is dependent upon the amplitude of oscillations thereof, so as to cause a shift in the relative phase of ions in the trap over time, and further wherein the parameters of the trapping field are arranged such that the spread of phases of at least some of the ions in the trap to be detected is greater than zero but less than about $2\pi$ radians over an ion detection time $T_m$.

The invention also extends to a method of trapping ions in an electrostatic trap having at least one trapping electrode, comprising: applying a substantially electrostatic trapping potential to the or each trapping electrode, so as to generate an electrostatic trapping field within the trap, for trapping ions of a mass to charge ratio m/q in a volume V such that they undergo multiple reflections along at least a first axis z; and applying a distortion to the geometry of the trap, and/or to the trapping potential applied to the or each trapping electrode, so as to cause a perturbation in the electrostatic trapping field which results in at least some of the ions of mass to charge ratio m/q to undergo a separation in phase of no more than about $2\pi$ radians over a measurement time period $T_m$. Preferably, such separation should be positive.

The invention also extends to a method of trapping ions in an electrostatic trap having at least one trapping electrode, comprising: applying a substantially electrostatic trapping potential to the or each electrode, so as to generate an electrostatic trapping field within the trap, for trapping ions in a volume V such that they undergo multiple reflections, along at least a first axis z, with a period of oscillation $\tau$ increasing with increasing amplitude of oscillation $A_z$ of ions trapped in the field over the volume V.

In still a further aspect of the invention, there is provided a method of determining the acceptability or otherwise of an electrostatic trap, comprising supplying a plurality of ions to the trap; detecting at least some of the ions in the trap; generating a mass spectrum therefrom; and either (a) ascertaining whether or not the peaks in that mass spectrum are split, split peaks being indicative of a poorly performing trap, and/or (b) determining the relative abundances of isotopes of a known ion in the mass spectrum, the degree to which these relative abundances correspond with predicted (theoretical or naturally occurring) abundances being indicative of the acceptability of the trap.

BRIEF DESCRIPTION OF THE DRAWINGS

The invention may be put into practice in a number of ways and some specific embodiments will now be described by way of example only and with reference to the accompanying Figures in which.

DETAILED DESCRIPTION OF THE PREFERRED EMBODIMENT

Figure 1:
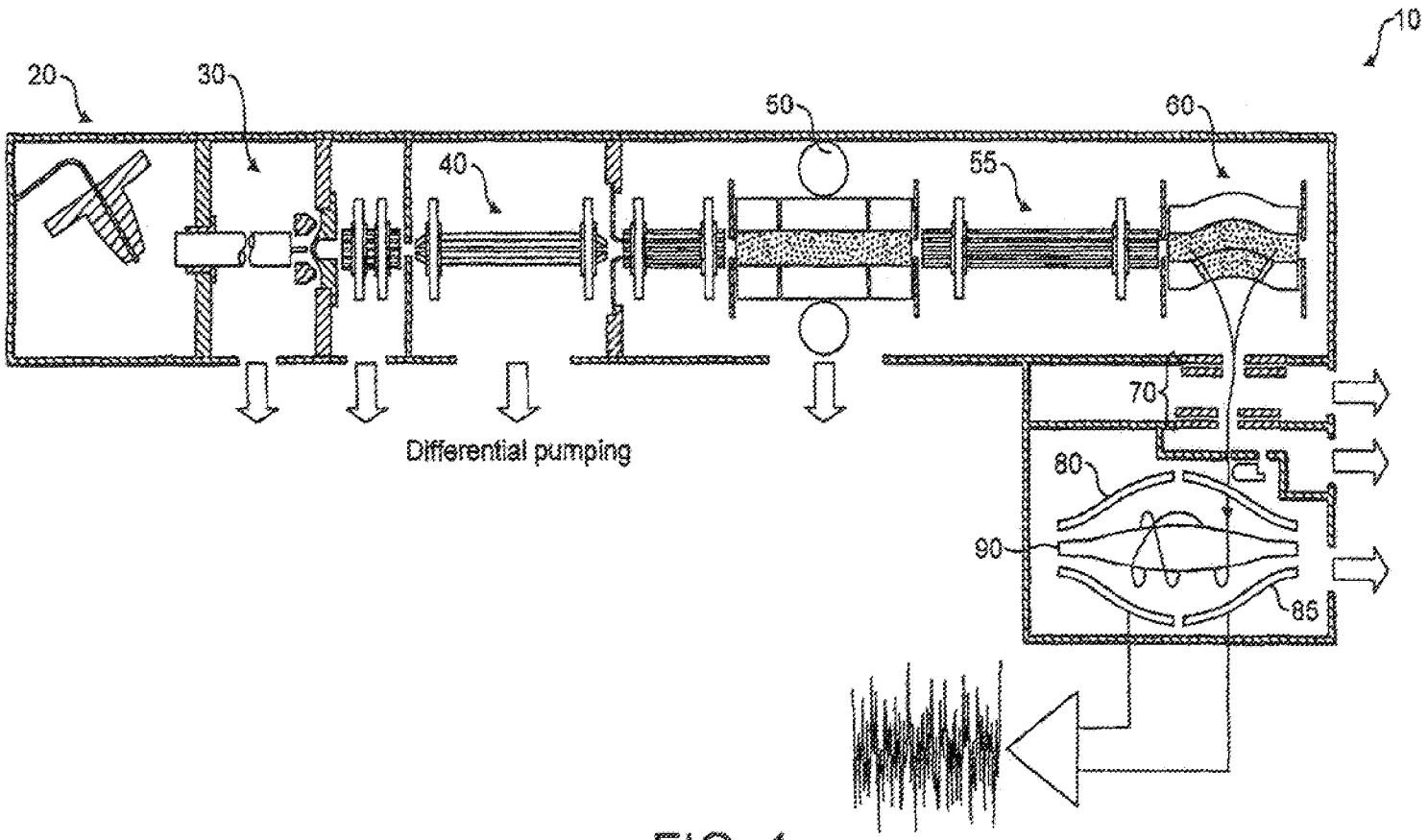
FIG. 1 shows a schematic arrangement of a mass spectrometer including an electrostatic trap and an external storage device.

Referring first to FIG. 1, a schematic arrangement of a mass spectrometer including an electrostatic trap and an external storage device is shown. The arrangement of FIG. 1 is described in detail in commonly assigned WO-A-02/078046 and will not be described in detail here. A brief description of FIG. 1 is, however, included in order better to understand the use and purpose of the electrostatic trap to which the present invention relates.

As seen in FIG. 1, the mass spectrometer 10 includes a continuous or pulsed ion source 20 which generates gas-phase ions. These pass through an ion source block 30 into an RF transmission device 40 which cools ions. The cooled ions then enter a linear ion trap acting as a mass filter 50 which extracts only those ions within a window of mass charge ratios of interest. Ions within the mass range of interest then proceed via a transfer octapole device 55 into a curved trap 60 which stores ions in a trapping volume through application of an RF potential to a set of rods (typically, quadrupole, hexapole or octapole).

As explained in more detail in the above-mentioned WO-A-02/078046, ions are held in the curved trap 60 in a potential well, the bottom of which may be located adjacent to an exit electrode thereof. Ions are ejected orthogonally out of the curved trap 60 into a deflection lens arrangement 70 by applying a DC pulse to the exit electrode of the curved trap 60. Ions pass through the deflection lens arrangement 70 and into an electrostatic trap 80. In FIG. 1, the electrostatic trap 80 is the so-called "Orbitrap" type, which contains a split outer electrode 85, and an inner electrode 90. Downstream of the Orbitrap 80 is an optional secondary electron multiplier (not shown in FIG. 1), on the optical axis of the ion beam.

In use, a voltage pulse is applied to the exit electrode of the curved trap 60 so as to release trapped ions in an orthogonal direction. The magnitude of the pulse is preferably adjusted to meet various criteria as set out in WO-A-02/078046 so that ions exiting the curved trap 60 and passing through the deflection lens arrangement 70 focus in time of flight. The purpose of this is to cause ions to arrive at the entrance to the Orbitrap as a convolution of short, energetic packets of similar mass to charge ratio. Such packets are ideally suited to an electrostatic trap which, as will be explained below, requires coherency of ion packets for detection to take place.

The ions entering the Orbitrap 80 as coherent bunches are squeezed towards the central electrode 90. The ions are then trapped in an electrostatic field such that they move in three dimensions within the trap and are captured therein. As is explained in more detail in our commonly assigned U.S. Pat.

No. 5,886,346, the outer electrodes of the Orbitrap 80 act to detect an image current of the ions as they pass in coherent bunches. The output of the ion detection system (the image current) is a "transient" in the time domain which is converted to the frequency domain and from there to a mass spectrum using a fast Fourier transform (FFT).

Having described the mode of operation of the Orbitrap 80 and its typical use within a mass spectrometer arrangement 10, a theoretical analysis of the trapping of ions within the Orbitrap 80 will now be provided, in order to gain a better understanding of the present invention.

Motion in an Ideal Field

As explained in U.S. Pat. No. 5,886,346, the ideal form of electrostatic field within the Orbitrap 80 has a potential distribution U(r,z), as defined in Equation (1) of the introduction above. Note that, in Equation (1), the parameter C is a constant. In this field, the motion of ions with mass m and charge q along the axis z is described as a simple harmonic oscillator with an exact solution defined in Equation (2) above, with $\omega_0=\sqrt{(qk/m)}$, see Equation 3 above. In other words, the period of oscillation $\tau(=2\pi/\omega_0)$ in that z direction is independent of the amplitude of oscillation of ions in the z direction, $A_z$.

Motion in a Perturbed Field: 2D Perturbation

In constructing a real electrostatic trap, the field defined by Equation (1) can only be approximated due to finite tolerances.

In cylindrical coordinates (r,ϕ,z), the potential distribution U can be written, generally, as:

$$U(r,\phi,z)=\frac{k}{2}\left[z^2-\frac{r^2}{2}\right]+\frac{k}{2}(R_m)^2\cdot\ln\left[\frac{r}{R_m}\right]+W(r,\phi,z). \tag{4}$$

Here, the parameters of the equation are as defined in connection with Equation (1), save that the constant C is replaced by a field perturbation W which is, in its most general form, three-dimensional.

If we consider the situation where W does not depend on z, and also satisfies the Laplace equation given by Equation (5) below:

$$\Delta W(r,\phi)=0 \tag{5}$$

It may be shown that the motion of ions in the z direction remains defined by Equations (2) and (3) above. In particular, the period of oscillation $\tau(=2\pi/\omega_0)$ remains independent on the amplitude of oscillation $A_z$ in the z direction. The general solution to Equation (5), in (xy) coordinates, may be written as $$U(x,y)=-\frac{k}{4}[x^2-y^2]a+\left[A.r^m+\frac{B}{r^m}\right]\cos\left\{m.\cos^{-1}\left(\frac{x}{r}\right)+\alpha\right\}+ b\cdot\ln\left(\frac{r}{D}\right)+E\cdot\exp(F\cdot x)\cos(F\cdot y+\beta)+G\exp(H\cdot y)\cos(H\cdot x+\gamma) \tag{6}$$

where $r=\sqrt{(x^2+y^2)}$, α,β,γ,a,$A_z$ B,D,E,F,G,H are arbitrary constants (D>0), and j is an integer. It should be noted that Equation (6) is general enough to remove completely any or all of the terms in Equation (1) that depend upon r, and replace them with other terms, including expressions in other coordinate systems (such as elliptic, hyperbolic, etc. systems of coordinates). However, such great deviations from axial symmetry are rarely advantageous in practice. The construction of an electrostatic trap is, in other words, preferably such that the perturbation W remains small. For example, matching elliptical deformation of both the inner and the outer electrodes of the Orbitrap, or parallel shifting of the inner electrode relative to the outer electrode along the x- or y-coordinate, will have no influence on Equations (2) and (3) (such that the period of oscillation τ remain independent of the amplitude of axial oscillations), whilst the tolerance requirements on such deformations for the construction of a trap which operates within acceptable boundaries are less strict.

Motion in a Perturbed Field: Problems with 3D Perturbations

The primary difficulties with a real electrostatic trap arise in the case where the perturbation W does depend on z (either with or without an additional dependence upon r and/or ϕ). In this case, Equations (2) and (3) are no longer exactly true and the period of oscillation τ becomes a function of the amplitude of oscillation $A_z$. The vast majority of manufacturing imperfections, to be discussed in further detail below, result in a perturbation W that has a dependence upon z at least (and, normally, also cross-terms $r^l z^m \cos^n(\phi)$, where l, j, n are integers). The effect itself is very complex. However, it is possible to obtain a useful and meaningful generalisation by considering two simple but contrasting situations.

Figure 2:
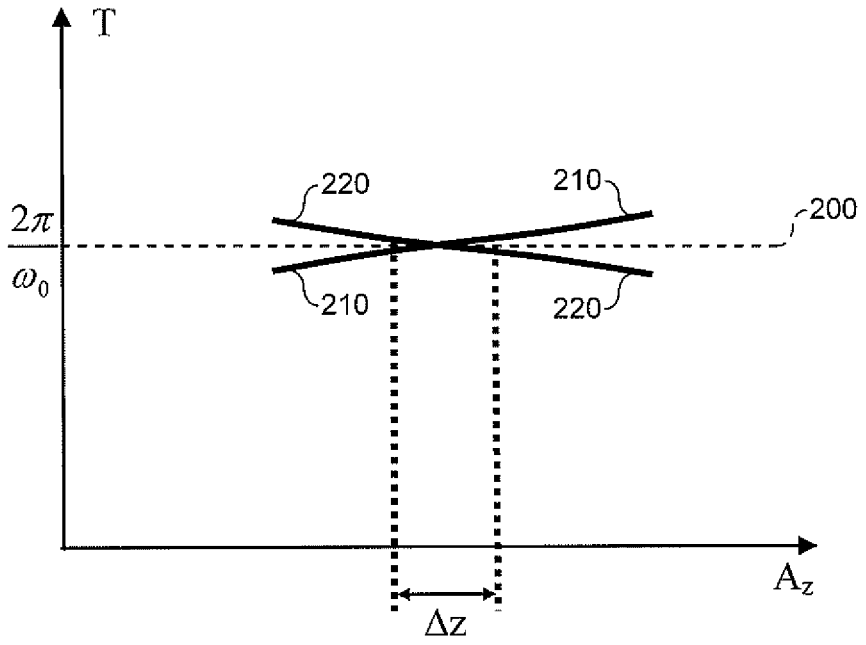
FIG. 2 shows plots of the dependence of the amplitude of oscillation on the period of oscillation in an ideal and a non-ideal electrostatic trap.

Referring to FIG. 2, some plots of the dependence of the period of oscillation τ upon the amplitude of oscillation of ions in the z direction are shown. The dotted line 200 represents the ideal situation where there is no perturbation (that is, the situation of Equation (1) or, alternatively, where the perturbation is not dependent upon z (as described in "Motion in a Perturbed Field: 2D Perturbation" above). The period of oscillation of ions in the electrostatic trap remains constant, for a given mass to charge ratio, regardless of the amplitude of those oscillations.

Where the electrostatic field is slightly non-linear (Equation (4)) and the perturbation W is dependent upon z, the period of oscillation τ starts to depend upon $A_z$. Line 220 in FIG. 2 illustrates, simplistically, the case where higher amplitudes result in shorter periods of oscillation T. Ions in the beam are spread over a range of amplitudes Δz and have a spread of initial phases $\Delta\theta_z$. It will of course be understood that the real dependence of the period of oscillation τ upon amplitude of oscillation $A_z$ is most unlikely to be linear for all possible $A_z$, as line 220 suggests, but showing a linear, monotonically decreasing period of oscillation τ with increasing $A_z$ permits more straightforward explanation. The situation where the dependence of period upon amplitude does not increase or decrease in a linear, monotonous fashion will be explored below.

Figure 3:
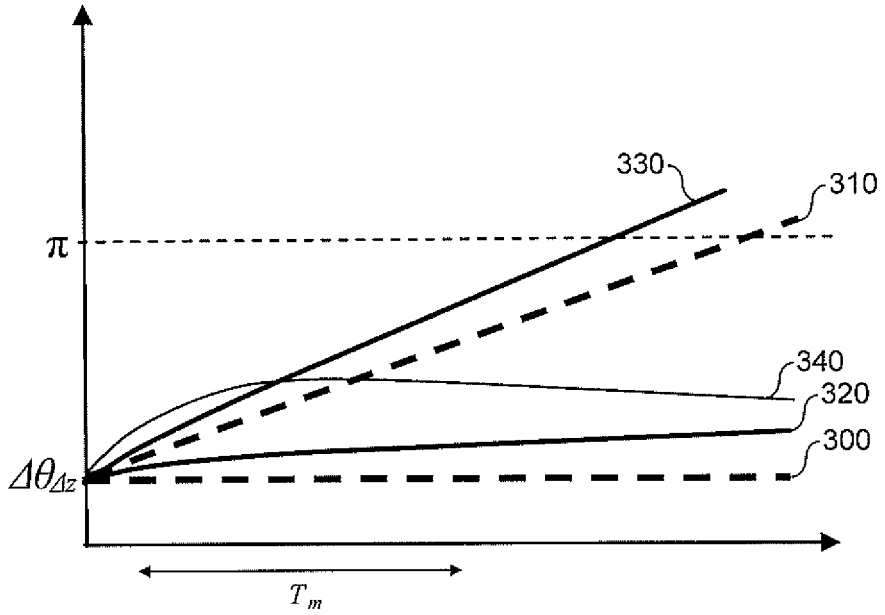
FIG. 3 shows the change in relative phase of ions in the electrostatic trap as a function of time t, in the presence of various perturbing factors.

For ions in the ideal field of Equation (1), and in absence of any collisions, the oscillation according to Equations (2) and (3) without shift of parameters will result in a fixed phase spread Δθ over time t. This is shown as dotted line 300 in FIG. 3.

Where the perturbation results in a slightly non-linear electric field, due to the perturbed potential distribution defined by equation (4), and that perturbation has a dependence upon z, the ions will still move in accordance with Equations (2) and (3). However, ions will now have a phase θ which changes with time t. In the case of a dependence of period τ on amplitude $A_z$ that is as shown by line 220 in FIG. 2 (τ decreases with increasing $A_z$), the spread of phases will increase with time. This is because ions with a higher $A_z$ will move faster, relatively speaking, and ions with lower $A_z$ will move relatively slower. The increase in the spread of phases as a consequence is shown by dotted line 310 in FIG. 3.

At the point where the phase spread exceeds $\pi$ radians, ions start to move with opposite phases. This in turn compensates image currents of each other which progressively reduces the overall signal.

There is a minimum detection period within the Orbitrap. The longer the detection period, the higher the resolution. On the other hand, extended measurement periods result in a phase spread shift that exceeds $\pi$ radians. Therefore, it may be seen that a first restriction upon the manufacture of a real electrostatic trap is that any perturbation introduced should result in a net change in relative phase of no more than about $2\pi$ radians, preferably no more than $\pi$ radians, over a sufficiently long measurement period $T_m$.

In fact, in a real trap, the increase in phase spread over time is generally not simply a result of a slightly non-linear field (due to a perturbation of the potential, W). When the number of ions in a beam is increased beyond a certain level (typically, beyond 10,000 to 100,000 ions), ion-ion interactions start to affect ion motion, as a consequence of space charge. In the ideal field (1), this results in a spreading of an ion beam that slows down with time, as the ion packets becomes large enough that the distance between ions reaches a high level. This small, time-dependent drift of phase $\theta$, which is a consequence of space charge and occurs even in the absence of a perturbation of the potential, is a known phenomenon and is shown schematically as line 320 in FIG. 3. It will be seen the line 320 asymptotically approaches a line with a non-zero slope.

In the case of a non-linear electric field, due to the perturbed potential distribution described by equation (4), which results in a period of oscillations $\tau$ that increases with increasing amplitude $A_z$ (line 210 of FIG. 2), this small time-dependent phase drift resulting from space charge effects is still present. In this case, however, the space charge effects represented by line 320 are associative with the increase in phase resulting from the dependence of period on amplitude given by line 210 in FIG. 2 and shown as line 310 in FIG. 3. Adding lines 310 and 320 results in line 330 of FIG. 3. Thus it will be seen that, even with the effects of space charge, the consequence of a perturbation on the ideal field which results in a period of oscillations decreasing with increasing amplitude $A_z$ is that the line 330 reaches the $\pi$ radian phase shift in less time. As explained above, this means that, for a given construction of electrostatic trap, the space charge effect merely reduces the maximum suitable measurement period $T_m$.

The consequences of a perturbation W resulting in a period of oscillation $\tau$ that decreases with amplitude $A_z$ is more problematic, however. Line 220 in FIG. 2 illustrates, again schematically and for the purposes of example only, this situation. Physically, the consequence of a dependence such as is shown in line 220 of FIG. 2 is that ions are "bunched" together. The reason for this is as follows. The small time-dependent drift of phase $\theta$ resulting from space charge is still present. However, this combines with the effect of the non-linear field which results in the dependence of T on $A_z$ shown in line 220 of FIG. 2 to produce a shift in phase illustrated by line 340 of FIG. 3.

One possible mechanism for this counter-intuitive behaviour is as follows. Ions at the edge of the ion beam are pushed to smaller or larger $A_z$. For example, an ion on the right-hand edge of the range of amplitudes $A_z$ of FIG. 2 is pushed by the space charge effect of other ions to a larger $A_z$, at the same time lagging in phase $\theta$. As a result of the dependence shown by line 220, however, a larger amplitude $A_z$ corresponds to a lower period of oscillation $\tau$ (and a higher frequency $\omega_0$) of oscillations, so that the ion is forced to catch up in phase $\theta$ and return to the same phase as ions in the middle of the beam.

Similarly, ions that are pushed to a smaller amplitude $A_z$ and forward in phase $\theta$ become slower and also return back to the same phase as ions in the middle of the beam. As a result, rather than continuously increasing the ion beam phase spread (as occurs in the other situation resulting in line 330 above), the ion beam stops increasing its phase spread. For certain non-linearities, as shown by line 340, the phase spread may even begin to decrease over time. Whilst at first glance this may appear desirable, in fact it has a number of consequences which are at best highly undesirable, and at worst can result in an unacceptably poor performance of the electrostatic trap. For example, the peak frequency will shift as a consequence of the curve 340, which in turn affects the measured m/q. In some cases, for example when non-linearity varies significantly over the cross-section of the ion beam, the beam may even split into two or more sub-beams, each with its own behaviour. This will result, in turn, in split peaks (shown in FIGS. 8*d* and 9*d* in particular, regarding which, see below), poor mass accuracy, incorrect isotopic ratios (as an intense ion beam decays more slowly than a less intense beam), poor quantitation etc. Moreover, these effects may well be different for differing mass to charge ratios, so that, even if a device can be optimised to minimise phase bunching for a specific mass to charge ratio, this may not improve (or may even make worse) the situation with other mass to charge ratios.

In reality, the perturbation W will have a complex structure such that different parts of the same ion beam, with the same mass to charge ratio, may experience vastly different effects. For example, one part of the beam could be self-bunched with one average rate $(d\theta/dt)_1$, a second part of the beam may experience rapid phase spreading (within time $t \ll T_m$), with a third part of the beam self-bunched at a different rate $(d\theta/dt)_2$. This will result in a split peak with a part of the peak at a frequency $\omega_0+(d\theta/dt)_1$ and another part at a different frequency $\omega_0+(d\theta/dt)_2$. The second part of the beam, which has experienced rapid phase expansion, will be greatly suppressed, again as explained above. Even more complicated scenarios can be envisaged and, rapidly, the mass accuracy of the device can be fatally compromised.

The foregoing discussion leads to the following conclusions. There is nothing that can be done from an electrostatic field point of view to avoid the inevitable space charge effects which result in a small drift in phase. It is also unrealistic to expect that the parameters of the trap can, in manufacture, be kept to such a tight tolerance that there is no perturbation to the ideal field (1) at all. Thus, the most preferred realistic scenario is that the parameters of the trap are optimised so that the electrostatic field is approximately hyper-logarithmic and has a perturbation to it W which is dependent on r and/or $\phi$ only. In this case, other than the small time dependent phase shift resulting from space charge, the phase shift of ions over time should be zero.

In the case where the perturbation W depends upon z as well as, or instead of, r and/or $\phi$, it is desirable to ensure that the trap parameters are optimised so that there is phase spreading, rather than phase bunching, over time, and that the phase spreading is at a sufficiently low rate that the time taken for the net phase spread to exceed $\pi$ radians is greater than an acceptable measurement time period $T_m$. This is not to imply that there can be no phase bunching at all, and indeed a small degree of phase bunching even without any phase separation may produce an acceptable performance, only that it is preferable that at least a majority of non-bunched ions survive with a phase spread less than $2\pi$ radians for the entire measurement period. The difficulties that result from phase bunching become less and less pronounced as the growth of $\Delta\theta$ over the measurement time scale $T_m$ decreases.

Figure 4:
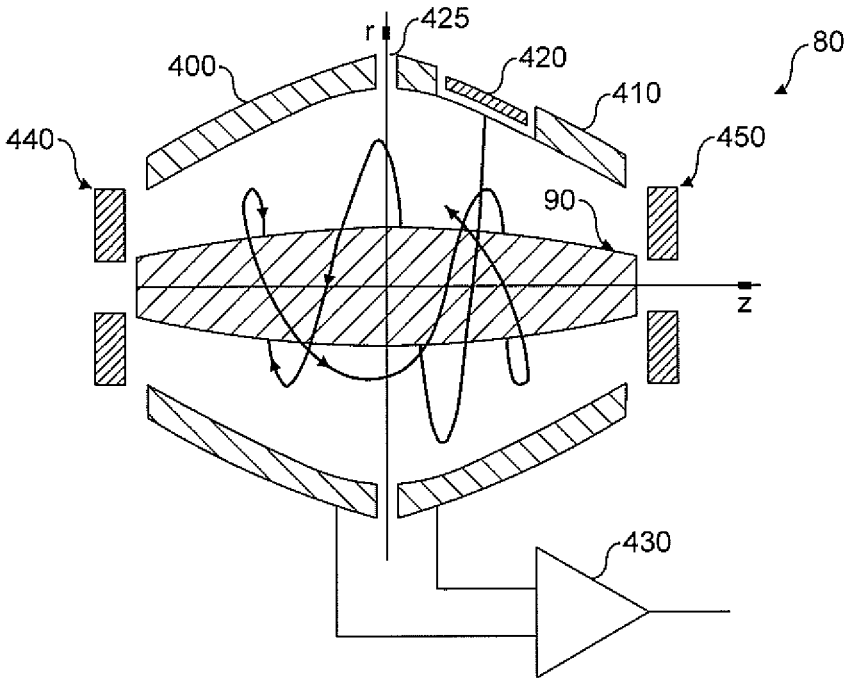
FIG. 4 shows a side sectional view of an electrostatic trap in accordance with a first embodiment of the present invention.

There are, of course, a large number of parameters that vary in the construction of an electrostatic trap, however, a number of particularly desirable optimisations have been identified. These have been implemented and are described now with reference to FIGS. 4 to 7. Referring first to FIG. 4, a schematic side view of an Orbitrap 80 is shown. The operation of the Orbitrap is as previously described and as set out in detail in, for example, U.S. Pat. No. 5,886,346. The Orbitrap 80 comprises an inner electrode 90 (shown in end section in FIG. 1) and split outer electrodes 400, 410. As may be seen in FIG. 4, the electrodes are shaped, so far as is possible within manufacturing tolerances, to have the hyper-logarithmic shape of Equation (1). Within the outer electrode 410 is a deflector 420. Ions are introduced into the trapping volume defined between the inner electrode 90 and outer electrodes 400, 410 through a slot 425 between the outer electrodes 400, 410.

End cap electrodes 440, 450 contain ions within the trapping volume. An image current is obtained using a differential amplifier 430 connected between the two outer electrodes 400, 410.

In one embodiment, the outer electrodes 400, 410 are stretched in the axial (z) direction. Axial stretching of the outer electrodes relative to the ideal shape improves mass accuracy over a wide mass range for ions injected using electrodynamic squeezing as described by Makarov in Analytical Chemistry Vol. 72 (2000) pages 1156-1162. Moreover, the inner electrode 90 may be radially compressed around its axis of symmetry in order to introduce a perturbation that results in gradual phase spreading. Additionally or alternatively, voltages may be applied to the end electrodes 440, 450.

Figure 5:
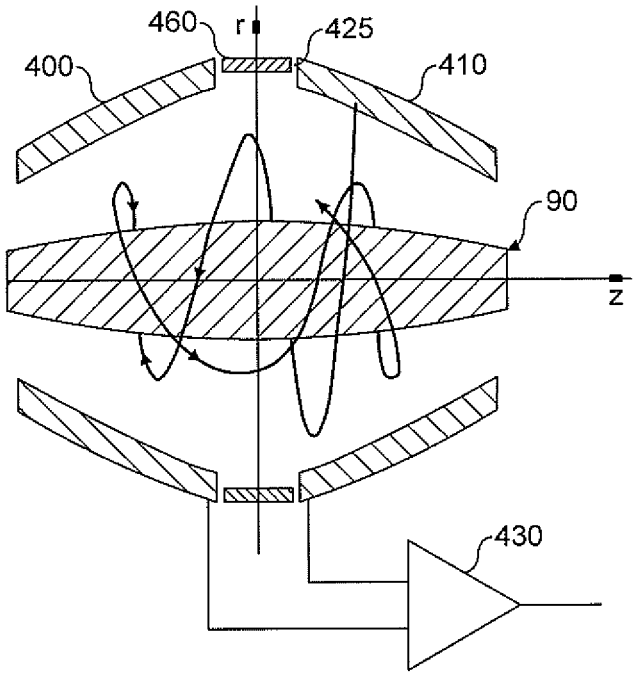
FIG. 5 shows a side sectional view of an electrostatic trap in accordance with a second embodiment of the present invention.

Since the ions exhibit harmonic motion along the z-axis of the trap, the ions exhibit turning points towards the extremities of the trap (+/−z). At these points, the ions are moving relatively slowly and thus experience the potential towards the trap extremities (in the axial direction) for longer than they experience the potential in the vicinity of the centre slot 425 (FIG. 5). The ions at these turning points are also relatively close to the outer electrodes. The result of this is that the shape of the trap in the vicinity of the turning points has a relatively significant impact on the ions. On the other hand, these turning points are axially inward of the outer extremities of the trap. In consequence, the shape of the trap at its axial extremities (outside of the turning points) has relatively limited effect upon the ions, since it is only the far field of these regions that affect the ions in the region of the turning points. In particular, the shape of the trap over the last 10% of its length is largely irrelevant.

As may be seen in FIG. 5, the ion injection slot 425 is axially central. The ions pass this point at maximum velocity and thus spend statistically less time there. They are also well spaced from the outer electrodes at that point. Thus, whilst the shape of the trap there has some impact on the ion trajectories, it is not so critical as the shape of the trap at the turning points. On the other hand the ion injection slot 425 in the embodiment of FIG. 4 is located away from the central (z) axis, and is generally in the region of one of the ion turning points. Thus the shape of the trap in the region of the slot 425 is relatively critical to trap performance.

As a related issue, it transpires that there is no apparent need to provide compensation (at the electrode extremities) for the truncation of the electrodes relative to their ideal infinite extent.

FIG. 5 shows an alternative arrangement to the embodiment of FIG. 4, although it is to be understood that the modifications and features of FIG. 5 are by no means mutually exclusive with those applied to the arrangement of FIG. 4. Nevertheless, features common to FIGS. 4 and 5 have been labelled with like reference numerals.

In FIG. 5, a spacer electrode 460 is mounted between the outer electrodes 410, 420 and a voltage may be applied to this. In general terms, employing a spacer between the outer electrodes so as to shift them apart may be desirable.

Figure 6:
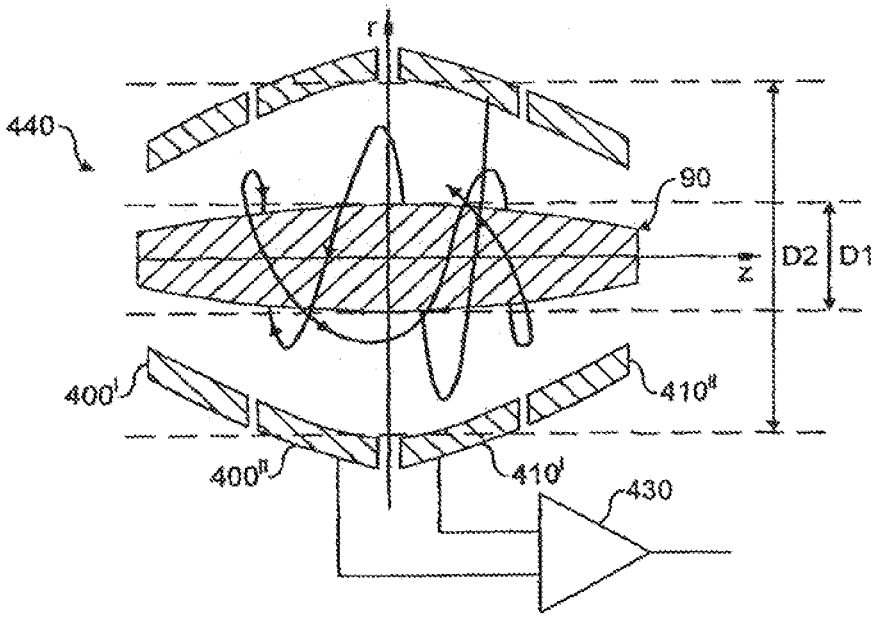
FIG. 6 shows a side sectional view of an electrostatic trap in accordance with a third embodiment of the present invention.

FIG. 6 shows still another embodiment. Here, the outer electrodes 400, 410 are segmented into multiple sections 400', 400", 410', 410". In that case, bias voltages may be applied to the segments. Each of the segment pairs may also be used for ion detection in this mode, allowing detection at multiples of ion frequency. For example, a triple frequency can be detected in the arrangement of FIG. 6 without the loss of signal to noise ratio, if the differential signal is collected between connected segment pairs 400'-410', and 400"-410". As another example, the signal may be detected between 400' and 410" (for example, with segment 400" and segment 410' grounded or biased), providing strong third harmonics of axial frequency, albeit at a lower signal to noise ratio. An increase in the detection frequency provides a benefit of higher resolving power within the limited detection time $T_m$. This is particularly useful for higher mass to charge ratio ions.

Figure 7:
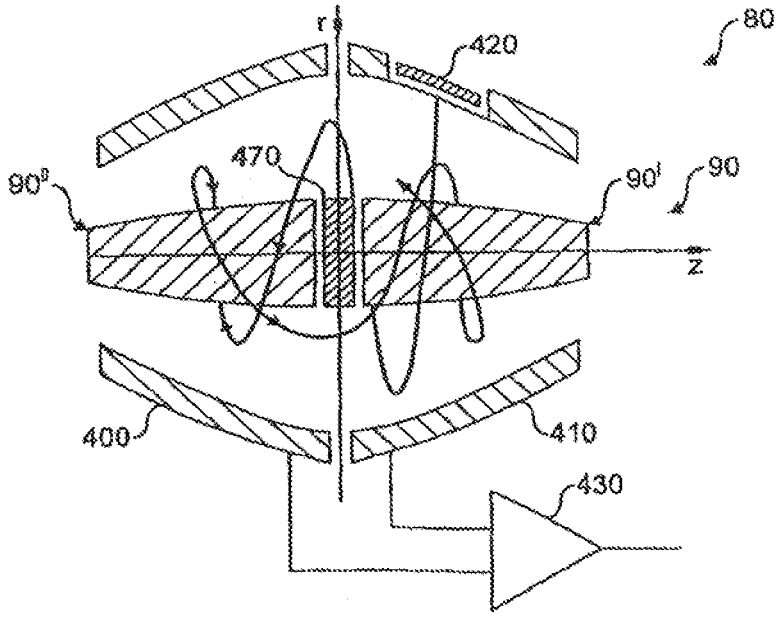
FIG. 7 shows a side sectional view of an electrostatic trap in accordance with a fourth embodiment of the present invention.

Turning finally to FIG. 7, still a further embodiment of an electrostatic trap 80 is shown. As with the arrangement of FIG. 4, the Orbitrap 80 comprises a pair of outer electrodes 400, 410 with a differential amplifier 430 connected across these. The outer electrode 410 also includes a deflector 420.

The inner electrode 90, however, is split into two segments 90', 90". Bias voltages may be applied to the segments. In addition to the segmentation, a spacer electrode 470 may also be included, preferably on the axis of symmetry (z=0). Different segments could, of course, also be employed for detection with or without the outer electrodes.

Although a number of different embodiments have been shown, it is to be understood that these are simply examples of adaptations to the dimensions, shape, size, control and so forth of the trap, to minimise the effect of perturbations that cause phase bunching and to maintain perturbations which optimise (i.e. minimise) the rate of increase of phase separation over the measurement period $T_m$. Any of the combinations described in connection with FIGS. 4 to 7 may be combined. Other means may be employed to produce multipole fields, that is, fields containing terms proportional to $z^n$, where $n>2$. Moreover, the Orbitrap 80 may be immersed in a magnetic field which provides mass dependent correction of aberrations. This may be especially effective for low mass to charge ratio ions that usually suffer the greatest scattering during extraction from an external storage device, an effect which is described in further detail in WO-A-02/078046.

It is also to be appreciated that the voltage on the deflection electrode 420 (FIGS. 4 and 7) should be chosen in such a way that the deflection electrode itself contributes a minimal non-linearity to the field. In general terms, the geometric distortions described in connection with FIGS. 4 to 7 have a magnitude of a few, to a few tens of, microns.

Empirically, some optimal ranges for geometric distortions have been determined and are listed below. Once more, it is stressed that these are experimentally observed observations that result in a limitation in the phase spread and are in no way intended to be limiting of the general inventive concept. In the following list, the dimension D2 is (as indicated in FIG. 6) the inner diameter of the outer electrodes 400, 410, at the axis of symmetry (z=0). The dimension D1 is the outer diameter of the central electrode 90, again the axis of symmetry (z=0).

(A) For present day machining technology, the optimal inner diameter of the outer electrodes D2 is between 20 and 50 mm, optionally 30 mm±5 mm;

(B) In preference, D1<0.8D2, optionally 0.4D2±0.1D2; (so that the inner electrode diameter D1 is preferably 12 mm when D2 is as in (A) above).

(C) The parameter $R_m$ in Equation (1) and Equation (4) is preferably in the range $0.5D2<R_m<2D2$, and optionally 0.75D2±0.2D2;

(D) The width of the entrance slot 425 (FIG. 4, for example), in the z direction, should in preference lie in the range 0.01D2 to 0.07D2 and optionally between 0.02D2 and 0.03D2, and, in the direction perpendicular to z (that is, in a direction looking into the page when viewing FIG. 4, for example), should be less than 0.2D2, optionally between 0.12D2 and 0.16D2;

(E) The overall inner length of the system should be greater than twice (D2−D1), and most preferably greater than 1.4 times D2;

(F) The accuracy of the shape of the outer electrodes, relative to the hyper-logarithmic form of Equation (1) should be better than $5\times10^{-4}$D2, and optionally better than $5\times10^{-5}$D2; where the inner diameter of the outer electrode is 30 mm, the total deviation is preferably 7:m or better. It has been found that the trap performance is better when the diameter of the outer electrodes is either nominally ideal or is slightly oversized (i.e. not undersized). By contrast the performance is enhanced when the central electrode is undersized (that is, too thin) by a few micrometers when the central electrode is of nominal maximum diameter 6 mm, a slightly (−4:m to −8:m) thinner electrode improves trap performance. Central electrodes of the correct nominal diameter or larger appear to result in a trap of reduced performance. One feasible explanation for this is that a slightly undersized central electrode introduces a negative high powered term (such as a fourth or higher power term) in the potential distribution parallel to the z-axis at a given diameter. The resultant slightly "flattened" potential, provided not too large, exerts a sufficient but not excessive force on the ions to prevent the unwanted "self-organization" of ions described above. In other words, the $-x^4$ or other high order term introduced by a slightly undersized central electrode appears to promote a slow phase spread. This is a desirable situation—the phase does spread (which prevents bunching) but not too fast to prevent ion detection in an acceptable time scale.

(G) The gap between the outer electrodes should be less than 0.005D2, in preference, and optionally around 0.001D2. It has however been ascertained that the axial gap between the outer electrodes may be 2-4:m too large without destroying the trap performance;

(I) The additional axial stretching of the outer electrodes relative to the ideal shape should be preferably in the range of 0 to $10^{-3}$D2, and optionally less than 0.0003D2;

(J) The degree of allowed tilt of the central electrode should be less than 1% of D2 and preferably less than 0.1% D2;

(K) The allowed misalignment of the outer electrodes should be less than 0.003D2 and preferably less than 0.0003D2;

(L) The allowed systematic mismatch between outer electrodes should be less than 0.001D2 and preferably less than $5\times10^{-5}$D2. In general, the mirror symmetry between the injection and detection sides of the Orbitrap appears to be very important. Typically, it is desirable that the maximum diameters of the left and right outer electrodes match each other to within around 0.005% which corresponds to 1-2:m in a 30 mm diameter trap; and (M) The allowed surface finish should be better than $2\times10^{-4}$D2 and optionally less than $3\times10^{-5}$ times D2. However, small, random variations in surface smoothness seem to have a beneficial effect. In other words, random surface defects appear to provide improved performance whereas long range (systematic) variations reduce performance.

It will be apparent from the foregoing (and with reference to the examples described below in connection with FIGS. 8, 9 and 10) that the different parameters, do not generally result in a 'perfect' or 'useless' trap but instead combine with one another in a complicated manner to present a trap that lies in a range between these two extremes. Observations nevertheless confirm that, where the parameters are within the ranges specified below, acceptable traps are produced; where the parameters are optimised to the magnitudes listed, currently good traps with correct peak shapes and positions are produced. Moreover, of the above, items (D), (E), (F), (G) and (H) appear to contribute most markedly to a degrading perturbation which forces dominance of phase bunching. Thus particular care should be taken in construction, to minimise the amplitudes or dimensions within the preferred ranges.

The foregoing description has explained a feasible physical basis for a degradation in the performance of a real electrostatic trap, in terms of perturbations to the ideal electrostatic field and the requirement that there should be at least a proportion of the ions which are not phase-bunched but which do not phase-separate too rapidly, if acceptable trap performance is to be realised. By controlling the parameters of the trap, for example by closely controlling the ranges of the parameters set out in (A) to (M) above, the degree to which any real trap meets the criterion of the present invention (minimising the rate of increase of phase spread) can be determined directly. However, again empirically, a number of indicators of likely trap performance (that is, likelihood that the specific requirement regarding rate of increase of phase spreading over the measurement period $T_m$) exist.

Various elements have several isotopes which exist in nature at a well known and defined ratio of relative abundances. For example, carbon has two stable isotopes, $^{12}C$, $^{13}C$ which exist in nature in the ratio of approximately 98.93% and 1.07% respectively. By obtaining a mass spectrum of the carbon isotopes using a candidate electrostatic trap, the measured relative abundances of the isotopes can provide an indication of the likely suitability of that candidate trap that is, the likelihood that it will meet minimum performance requirement. The consequence of a badly-performing trap, in which non-self-bunching signals decay very quickly (over time $t<<T_m$) results in only self-bunched signals (such as in curve 340 of FIG. 3) surviving. Although such self-bunched signals give the impression of acceptability, since peaks in a mass spectrum are narrow and peak intensity is good, the smaller isotopic peak for $^{13}C$ appears much smaller than natural abundance ratios would predict. It may also be split into two or more sub peaks.

As a rule of thumb, therefore, if a real trap indicates an apparent natural abundance of $^{13}C$ of less than about 0.7% (where its predicted abundance should be in the region of 1.07%), the trap would typically be rejected.

Figure 8A:
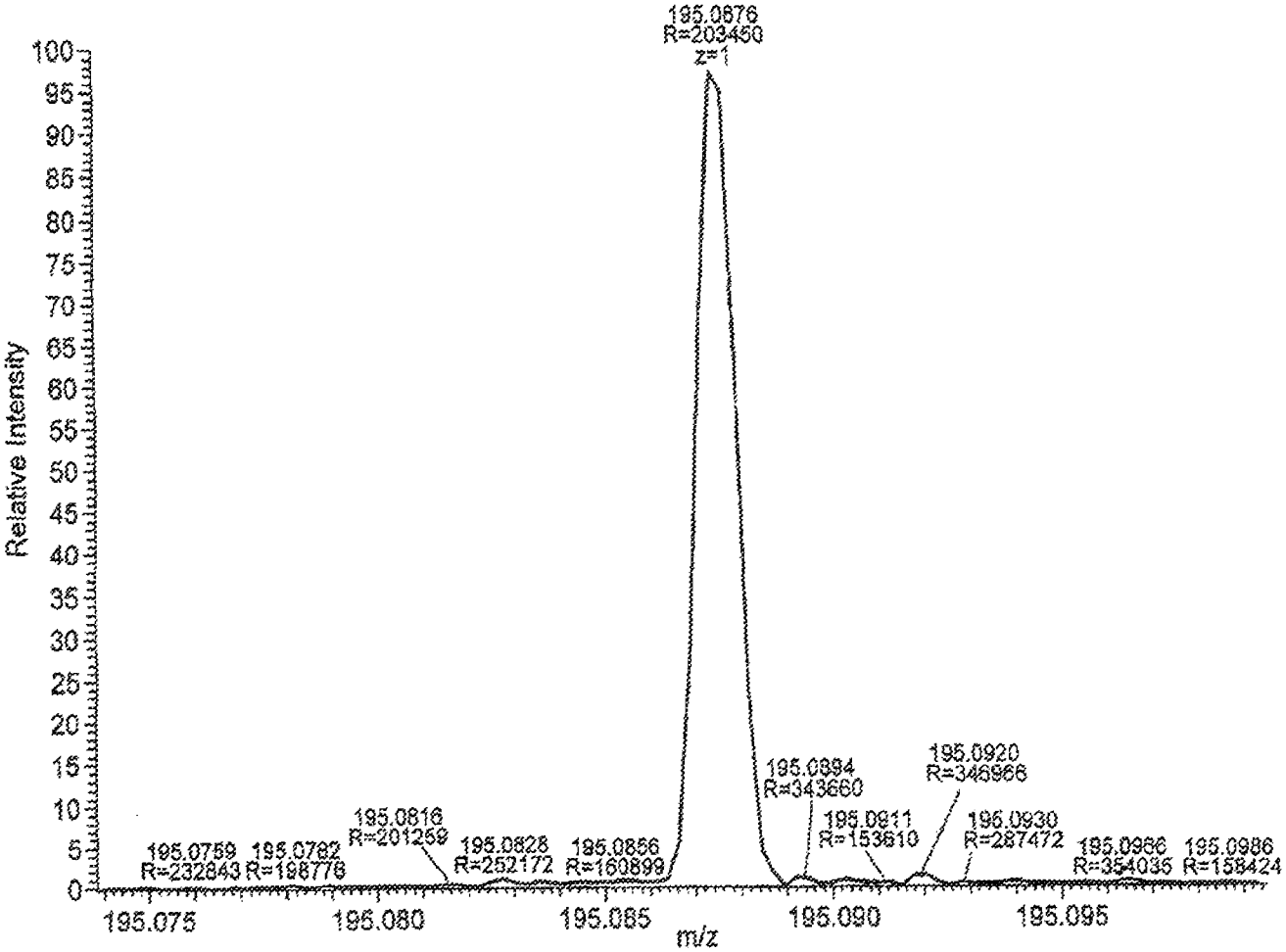
FIGS. 8*a*-8*d* show mass spectra from a first sample at around m/z=195, with increasing degrees of non-linearity introduced into the electrostatic field such that increasingly rapid phase separation occurs.
Figure 8B:
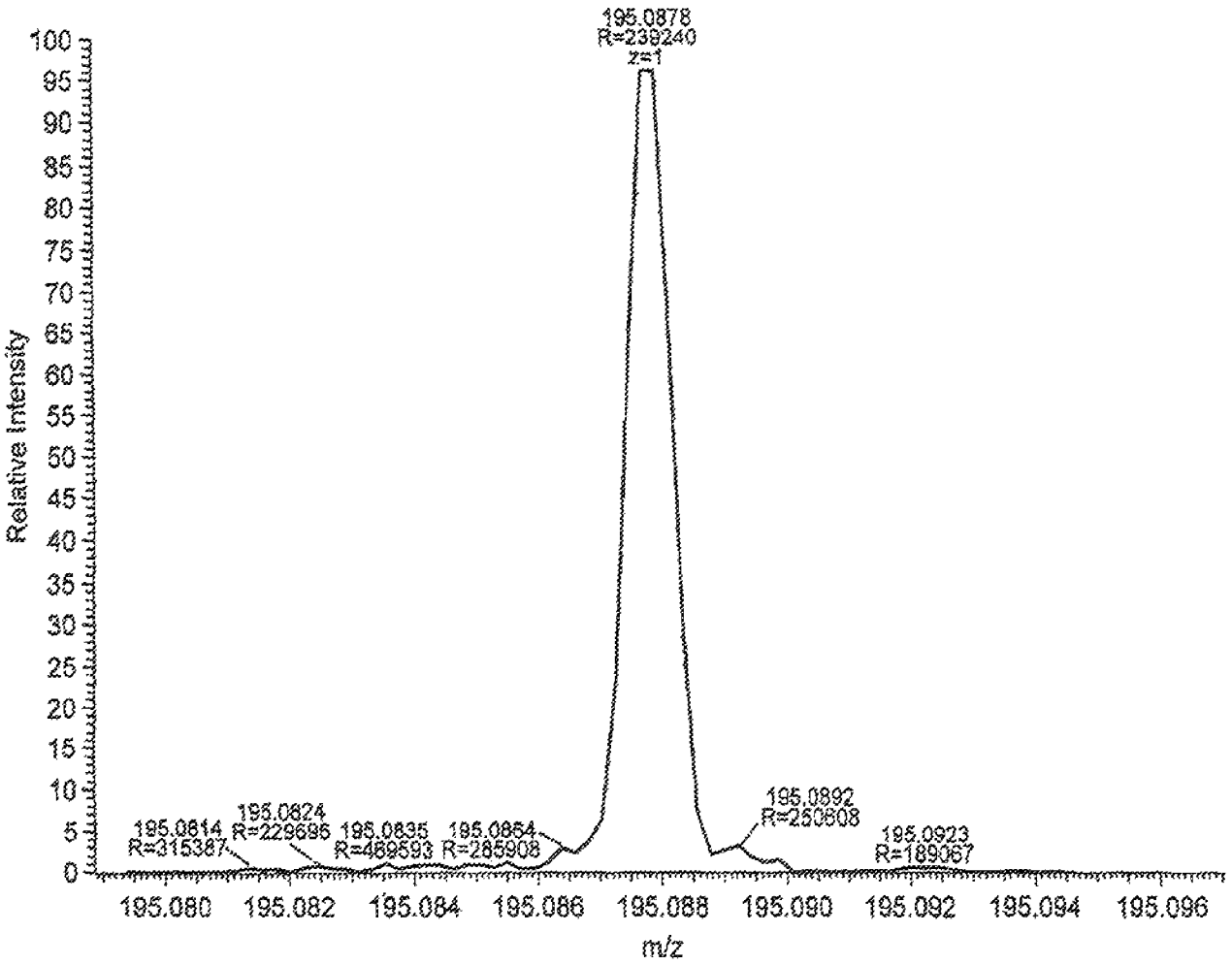
Figure 8C:
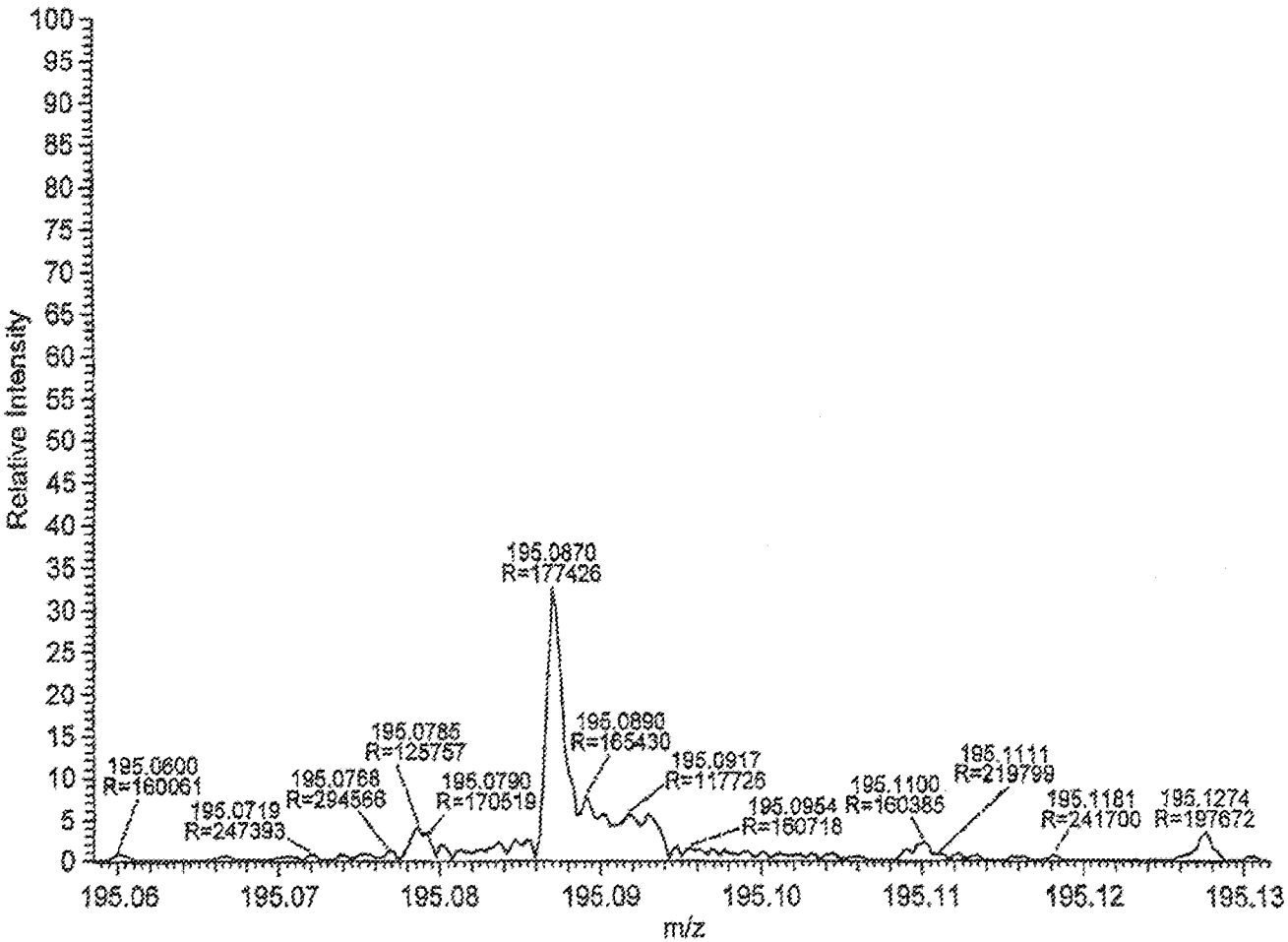
Figure 8D:
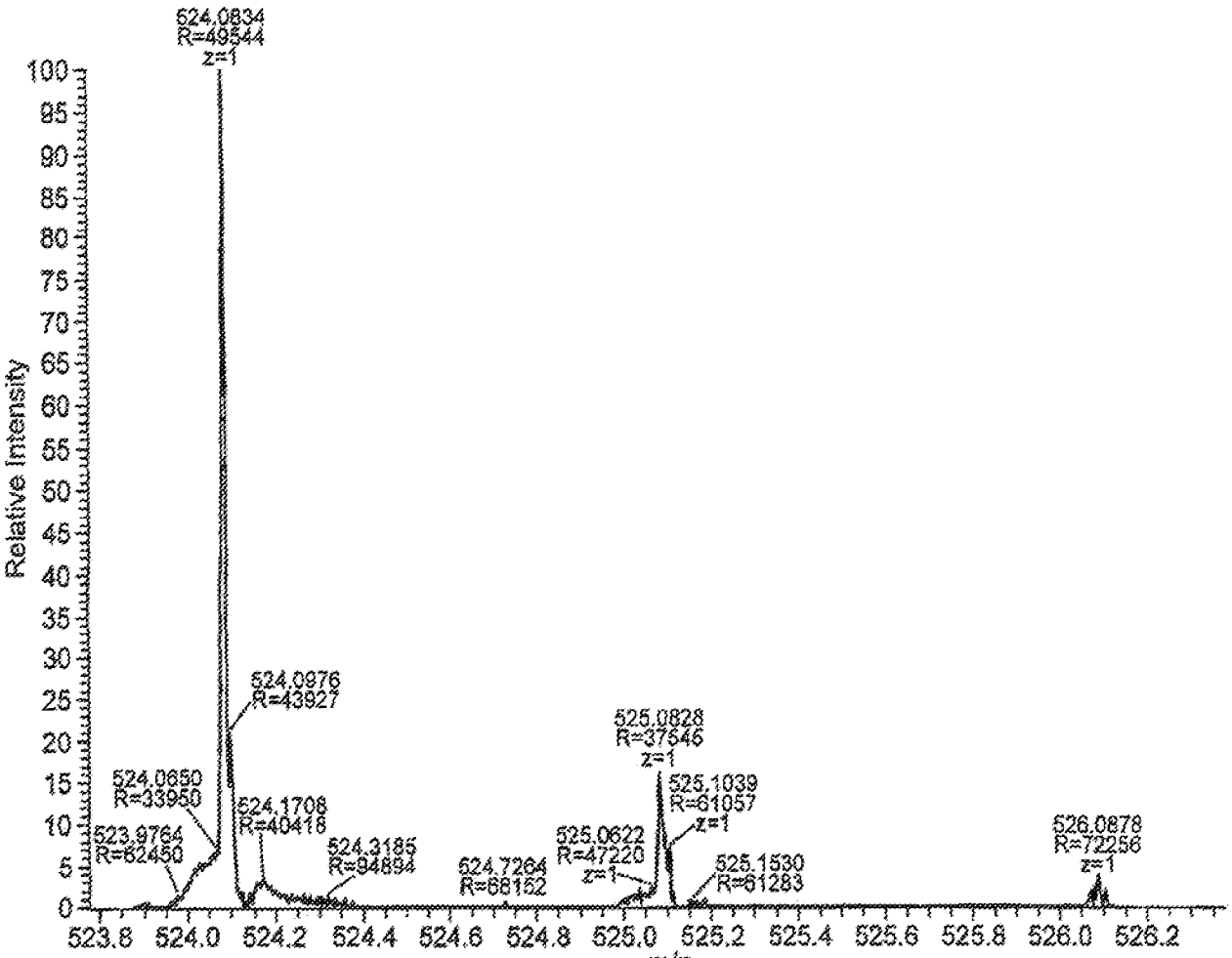
Figure 9A:
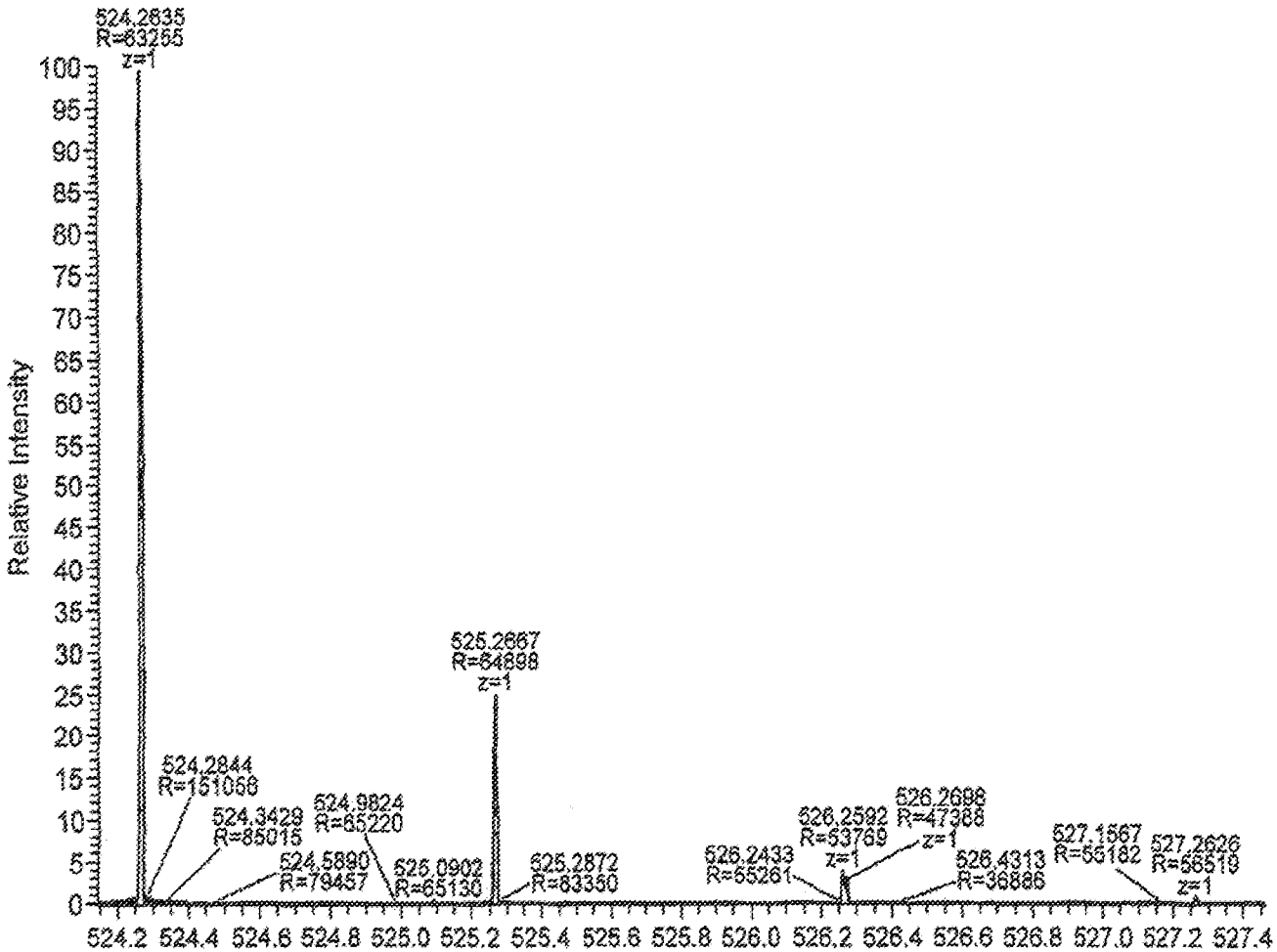
FIGS. 9*a*-9*d* show mass spectra from a second sample at around m/z=524, with increasing degrees of non-linearity introduced into the electrostatic field such that increasingly rapid phase separation occurs.

FIGS. 8*a-d* and 9*a-d* show plots of ion abundance against m/z (i.e., mass spectra) for m/z around 195 and m/z around 524, respectively, with differing amounts of field perturbation. In particular, FIG. 8*a* shows a zoom-in of mass spectrum at nominal mass 195. FIG. 9*a* shows a mass spectrum with a main peak at nominal mass 524 and two smaller peaks at nominal masses 525 and 526 indicative of the presence of two isotopes. The label for each peak lists m/z to 4 decimal places together with the resolving power of the Orbitrap. The relative abundances of these two isotopic peaks (normalized to the intensity of the main peak) are 26% and 4% respectively, in the ideal limit.

FIGS. 8*a* and 9*a* are obtained from an Orbitrap that operates with excellent parameters, that is, the rate of decay of the transient (or, put another way, the rate of increase in phase separation) is very slow. Here, peak resolution is limited by the length of the stored transient (i.e. the measurement time $T_m$), which in FIGS. 8*a* and 9*a* is 0.76 seconds.

Figure 9B:
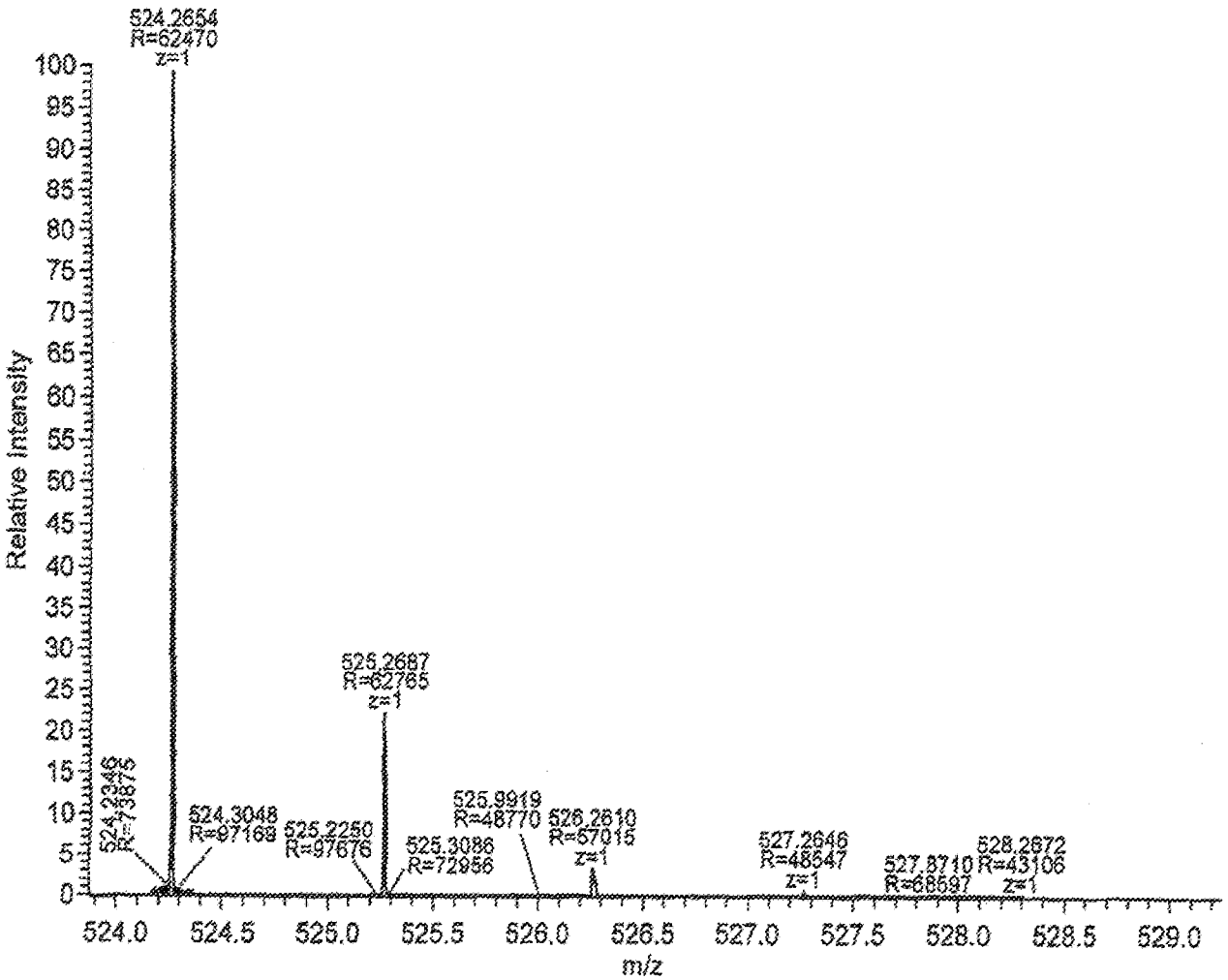

FIGS. 8*b* and 9*b* show mass spectra over the same ranges, using the same ions, but with a slight non-linearity in the electrostatic trapping field resulting in a discernable but acceptable amount of phase spreading over the measurement time $T_m$. It will be noted in FIG. 8*b* that the main peak has developed small wings on each side and that the measured peak position is also shifted very slightly to a lower apparent m/z. FIG. 9*b* also shows a very slight shift in the peak positions of the main peak and the two isotopes, and also the relative abundances of the isotopes are slightly different from those predicted. Nevertheless, the peaks do show good shape and there is no peak splitting.

Figure 9C:
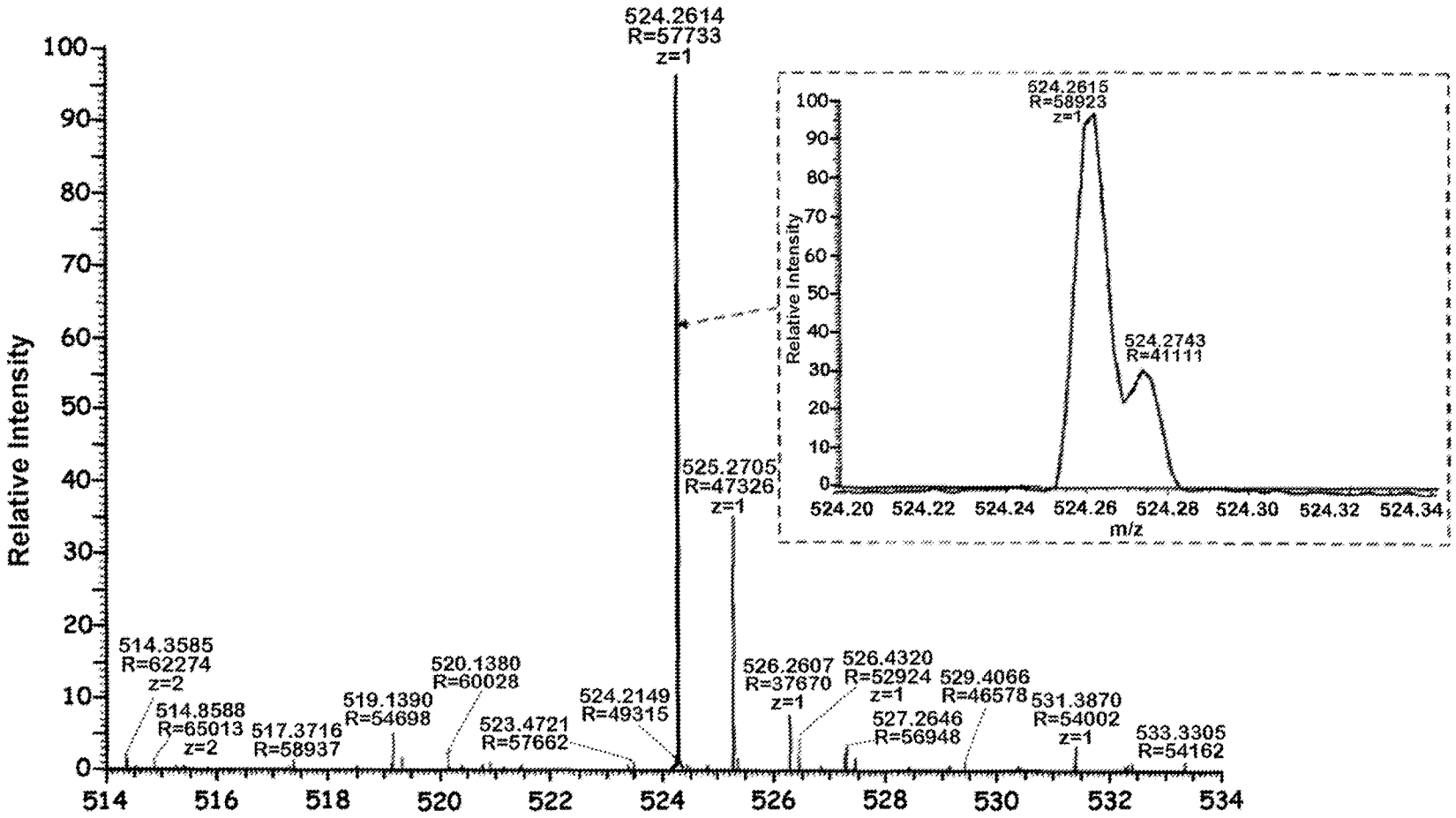

Turning to FIGS. 8*c* and 9*c*, the mass spectra of an Orbitrap with an unacceptably rapid phase expansion are shown, again for the same ions as were employed in respect of FIGS. 8*a*, 8*b*, 9*a* and 9*b* respectively. In FIG. 8*a*, the main peak is seen to be badly suppressed (abundance less than 40% of the 'true' abundance illustrated in FIG. 8*a*) and with a larger number of adjacent peaks which alter the true shape of the peak as well. FIG. 9*c* illustrates the problems of rapid phase expansion (leaving just phase bunched ions to be detected within a short amount of time, relative to the total measurement time $T_m$) as well. The main peak is suppressed (although in FIG. 9*c* its intensity has been renormalized to 100%) and the two isotopes show a much higher relative abundance than they should (around 37% and 7% respectively, compared with theoretical values of 26% and 4.5%). Inset into FIG. 9*c* is a zoomed part of the spectrum around the main peak, contrary to the correct appearance (that is, the peak shape of FIGS. 9*a* and 9*b*).

Figure 9D:
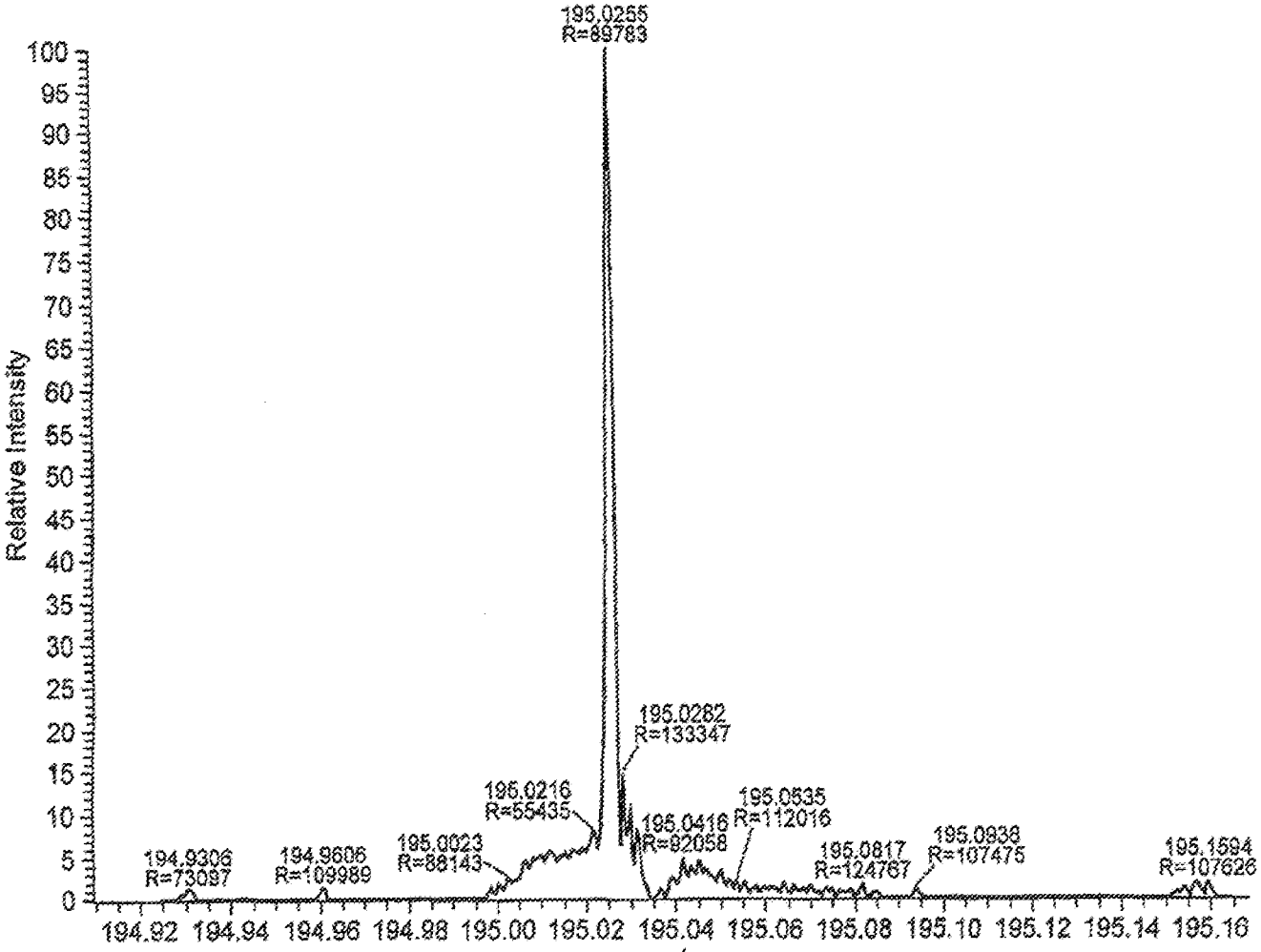

Finally, for completeness, FIGS. 8*d* and 9*d* show mass spectra where a very large non-linearity exists or is added to the trap so that any ions that are not phase bunched become undetectable within a very short timescale ($<<T_m$). In FIG. 8*a* the poor peak shape is apparent—the narrow 'spike' is a result of the phase bunched ions and the smeared signal either side of that spike is a result of the rapidly decaying phase spreading signal. The mass spectrum of FIG. 9*d* demonstrates similar problems with the main peak (a sharp spike resulting from phase bunched ions together with a wide spread of minor peaks surrounding the main peak). Moreover, the smaller isotopic peaks are also severely split (into a 'spike' and a spread of side bands) due to the phase bunched and rapidly phase spreading ions respectively. The relative magnitudes of the main and isotope peaks are also nowhere near the theoretical values.

Figure 10A:
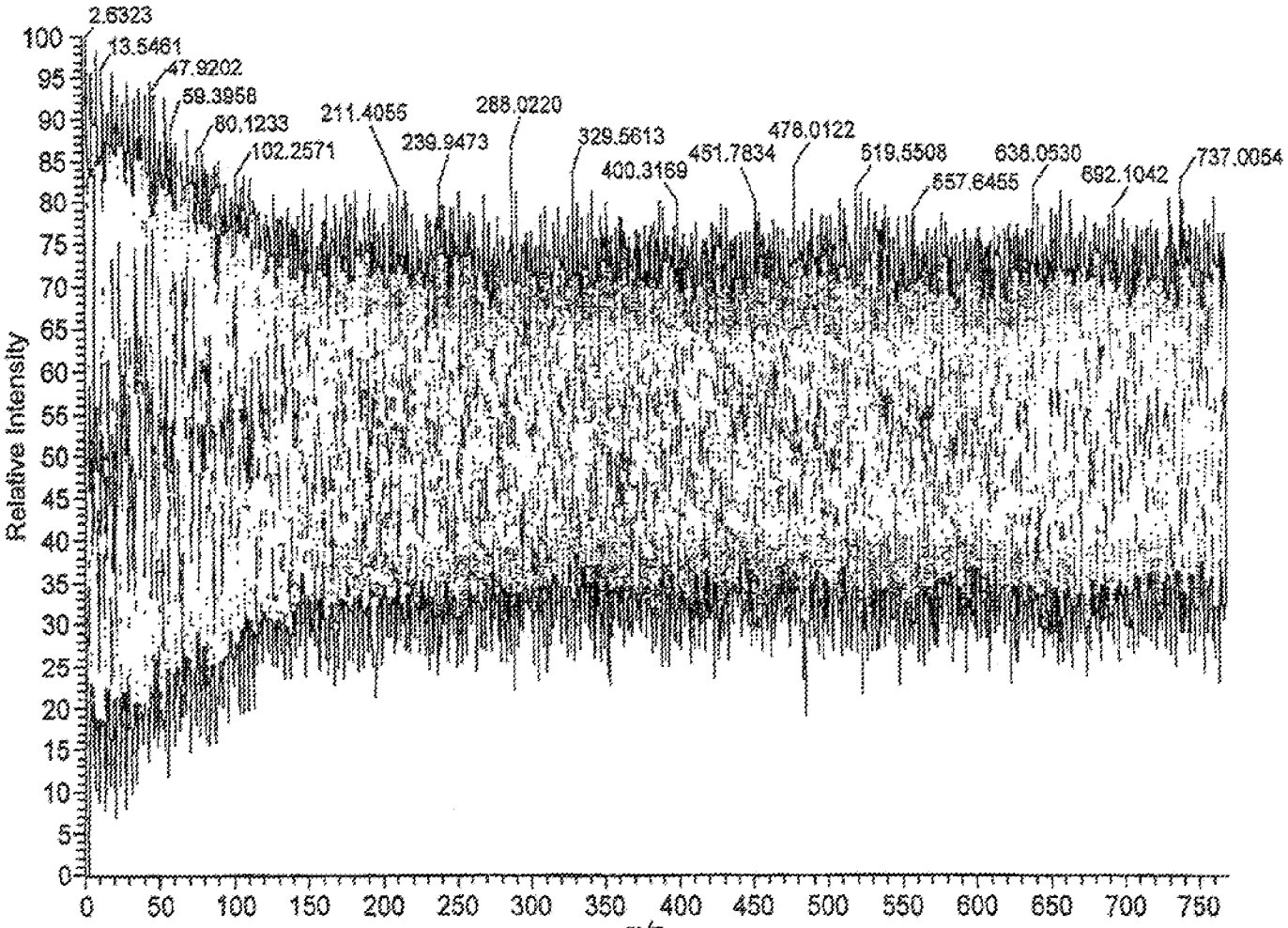
FIG. 10*a* shows a transient produced from an EST with optimised parameters, resulting in a gradual spread of phases and a gradual decay in the transient.
Figure 10B:
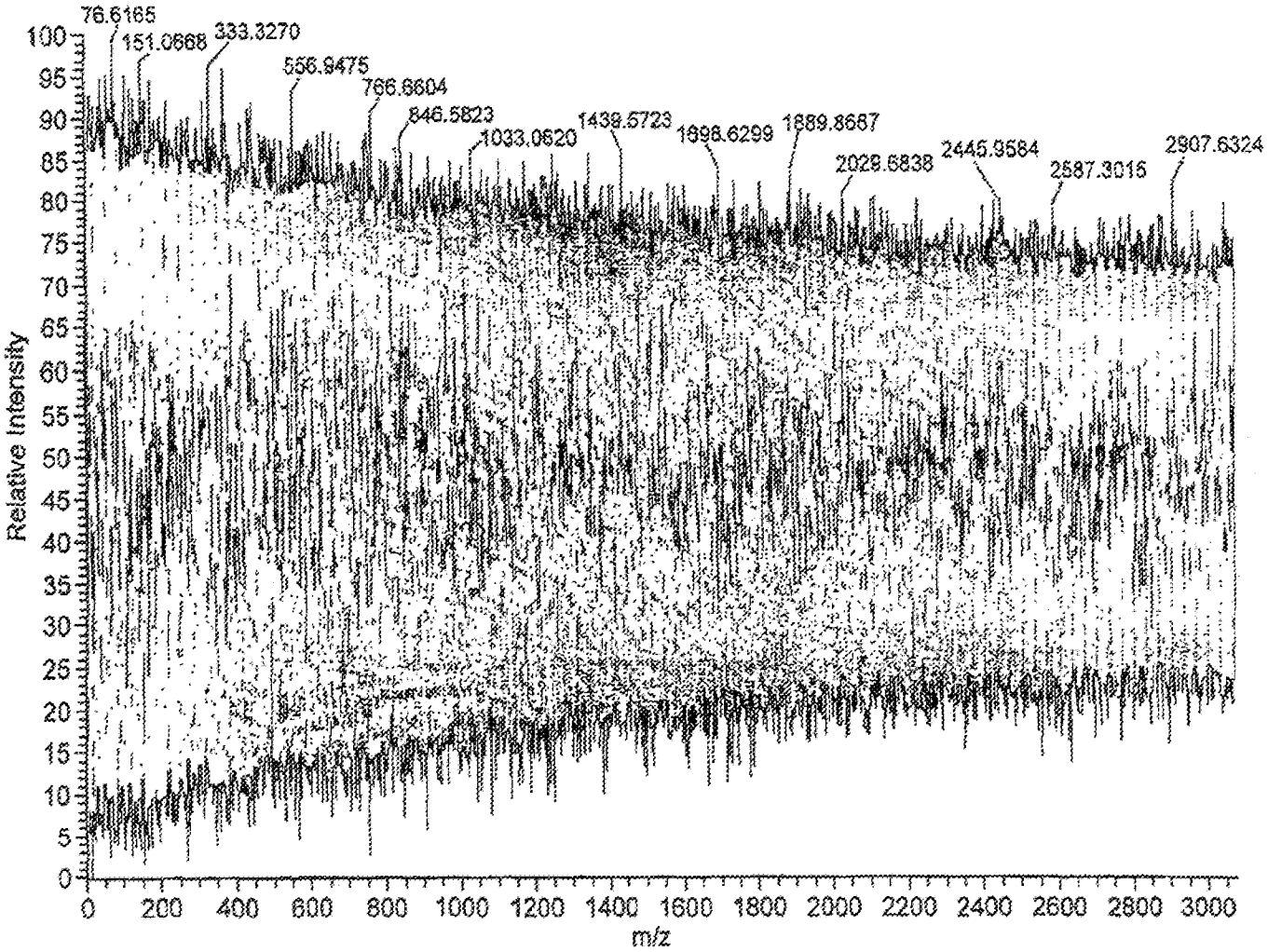
FIG. 10*b* shows a transient produced from an EST with poor parameters, resulting in a rapid spread of phases and a rapid initial decrease in the magnitude of the transient.

FIGS. 10*a* and 10*b* show transients (in the time domain) from traps with rapidly and slowly increasing phase spreads, respectively. It will be seen in FIG. 10*a* how the transient clearly contains a rapidly decaying component (over approximately 200 msec) and a slower decaying component (beyond 200 msec or so). This is what results in the split peaks of FIGS. 9*c* and 9*d*, for example. FIG. 10*b*, by contrast, shows a transient with a much more gradual decay, even over 3 seconds (note the difference in scales on the 'x' axis, between FIGS. 10 and 10*b*). The transient of FIG. 10*b*, once transformed into a mass spectrum, shows good mass accuracy, peak shape and so forth, as illustrated in FIGS. 8*a*, 8*b*, 9*a* and 9*b*.

Another indicator of poor trap parameters is the presence of an unusual non-linearity in the mass calibration. For example, if a non-monotonous dependence is noted in the mass range, rather than a linear function, it is generally concluded that the trap parameters will not meet the requirement for the maximum rate of phase spreading. Good Orbitraps tend to have a specific dependence of mass deviation on ion injection energy: from 0 to 40 ppm per 150V injection energy increase appears to be indicative of a functional trap. Those traps exhibiting a negative slope (of about −5 to −10 ppm or more) do not generally work. To an extent this can be mitigated (compensated) by the use of a larger spacer electrode 460 (FIG. 5), which results in the outer electrodes 410, 420 being moved outwards, which in turn weakens the field at the trap edges.

Finally, as explained above, the presence of split peaks, resulting from the complex structure of the perturbation W, normally provides a good clue that the performance of the trap in general will not be acceptable.

To optimise the stability of the construction of an electrostatic trap, having optimised the parameters themselves such as in accordance with (A) to (M) above, it is preferable to use temperature invariant materials in the design, such as Invar™ for the trap itself, and quartz or glass for insulation. In addition, high or ultra-high vacuum should be maintained within the volume traversed by the ions.

It is of course to be understood that the invention is not limited to the various embodiments of Orbitrap described above, and that various modifications may be contemplated. For example, as described in our copending application no GB0513047.1, the contents of which are incorporated by reference in their entirety, the Orbitrap electrodes may be formed from a series of rings rather than one or more solid electrodes. In that case, in order to introduce the desirable perturbation W to the ideal hyperlogarithmic electrostatic potential $U(r,\phi,z)$, the rings can be manufactured to have a shape that conforms to an equipotential of the perturbed field $U'(r,\phi,z)$. On the other hand, it may be preferable as well or instead to separate or compress some or all of the rings relative to one another in the axial (z) direction to create the same effects as are listed in (A)-(M) above. For example, spreading the outer electrode rings relative to the ideal equipotential mimics the desirable "flattened" shape discussed in (F) above. Compressing the inner rings together likewise mimics the smaller diameter inner electrode arrangement that is beneficial.

Indeed, the invention is not limited just to the Orbitrap. The ideas may equally be applied to other forms of EST including a multi-reflection system with either an open geometry (wherein the ion trajectories are not overlapping on themselves after multiple reflections) or a closed geometry (wherein the ion trajectories repetitively pass through substantially the same point). Mass analysis may be based on frequency determination by image current detection or on time-of-flight separation (e.g. using secondary electron multipliers for detection). In the latter case, it will of course be apparent that a phase spread of $2\pi$ radians corresponds with a spread of time-of-flights of ions of one period of reflection. Various examples of ESTs to which the invention may be applied are described in the following non limiting list: U.S. Pat. No. 6,013,913, U.S. Pat. No. 6,888,130, US-A-2005-0151076, US-A-2005-0077462, WO-A-05/001878, US-A-2005/0103992, U.S. Pat. No. 6,300,625, WO-A-02/103747 or GB-A-2,080,021.

The invention claimed is:

1. A method of mass analyzing ions in an electrostatic trap, comprising:

applying a substantially electrostatic potential to at least a part of the electrode assembly, such that the ions undergo substantially isochronous multiple reflections and/or oscillations in a volume V;

causing a perturbation of the electrostatic potential so that a phase spread for a first number of ions in the volume V increases during an ion detection period $T_m$, but a phase spread for a second number of ions in the volume V decreases during the ion detection period $T_m$.

2. The method as claimed in claim 1, wherein the phase spread for the first number of ions increases continuously during the ion detection period $T_m$.

3. The method as claimed in claim 1, wherein the phase spread for the second number of ions decreases after an initial increase in the phase spread.

4. The method as claimed in claim 1, wherein the first number of ions is such that the effect of space charge on the ion motion is negligible and the second number of ions is such that space charge affects the ion motion.

5. The method as claimed in claim 1, wherein the second number of ions is at least 10,000 ions.

6. The method as claimed in claim 1, wherein the second number of ions is in the range 10,000-100,000 ions.

7. The method as claimed in claim 1, wherein the phase spread of the ions is minimized such that the phase spread is less than $\pi$ radians over the ion detection period $T_m$.

8. An electrostatic trap for mass analyzing ions, comprising:

an electrode assembly arranged to generate a substantially electrostatic potential such that ions undergo substantially isochronous multiple reflections and/or oscillations in a volume V defined by the electrode assembly;

wherein the geometry of the electrode assembly provides a perturbation of the electrostatic potential so that a phase spread for a first number of ions in the volume V increases during an ion detection period $T_m$, but a phase spread for a second number of ions in the volume V decreases during the ion detection period $T_m$.

9. The electrostatic trap as claimed in claim 8, wherein the phase spread for the first number of ions increases continuously during the ion detection period $T_m$.

10. The electrostatic trap as claimed in claim 8, wherein the phase spread for the second number of ions decreases after an initial increase in the phase spread.

11. The electrostatic trap as claimed in claim 8, wherein the first number of ions is such that the effect of space charge on the ion motion is negligible and the second number of ions is such that space charge affects the ion motion.

12. The electrostatic trap as claimed in claim 8, wherein the second number of ions is at least 10,000 ions.

13. The electrostatic trap as claimed in claim 8, wherein the second number of ions is in the range 10,000-100,000 ions.

14. The electrostatic trap as claimed in claim 8, wherein the phase spread of the ions is minimized such that the phase spread is less than $\pi$ radians over the ion detection period $T_m$.

* * * * *